US005651542A

United States Patent [19]

Yamauchi et al.

[11] Patent Number: 5,651,542

[45] Date of Patent: Jul. 29, 1997

[54] PAPER FEEDER

[75] Inventors: Hirokazu Yamauchi, Uji; Masashi Hirai, Ikoma; Tatsuya Inoue; Masahiko Fujita, both of Nara, all of Japan

[73] Assignee: Sharp Kabushiki Kaisha, Osaka, Japan

[21] Appl. No.: 503,585

[22] Filed: Jul. 18, 1995

[30] Foreign Application Priority Data

Jul. 19, 1994 [JP] Japan ..... 6-167099
Sep. 30, 1994 [JP] Japan ..... 6-236606

[51] Int. Cl.[6] ..... B65H 3/52

[52] U.S. Cl. ..... 271/122; 271/125; 271/258.02

[58] Field of Search ..... 271/122, 124, 271/125, 114, 116, 10.03, 10.11, 258.02

[56] References Cited

U.S. PATENT DOCUMENTS 4,627,607 12/1986 Ishii ..... 271/122
5,016,866 5/1991 Takahashi ..... 271/122

FOREIGN PATENT DOCUMENTS 59-187647 12/1984 Japan .
63-185745 8/1988 Japan .

*Primary Examiner*—David H. Bollinger

[57] ABSTRACT

A paper feeder includes a feed roller and a reverse roller urged against the feed roller by a fulcrum. The fulcrum is located at a specific angles as measured from plane parallel to the contact area of the rollers clockwise from the feed direction of one sheet of paper. The specific angles results in a widened range of the contact pressure between the rollers.

7 Claims, 27 Drawing Sheets

PAPER FEEDER

BACKGROUND OF THE INVENTION

1. Field of the Invention

The present invention relates to a paper feeder for feeding paper with rollers. The feeder may be applied to, for example, an image former, a paper reverser, etc.

2. Description of the Prior Art

FIG. 1 shows a conventional paper feeder, which includes a feed roller 2 and a reverse roller 3. Transmitted to the feed roller 2 through a clutch 7 is torque (in the direction of arrow a) for feeding paper in the feed direction (arrow A). Transmitted to the reverse roller 3 through a clutch 8 is torque (in the direction of arrow a) for returning the paper reversely to the feed direction (arrow A). The reverse roller 3 is fitted with a torque limiter 9, which allows the reverse roller 3 to rotate in the feed direction (arrow b) when one sheet of paper passes between the rollers 2 and 3, but rotates the reverse roller 3 in the reverse direction (arrow a) when two (or more) sheets pass between the rollers. The reverse roller 3 is supported through a lever 5 on a fulcrum 6 and urged by a spring 4 against the feed roller 2. This urging force is so determined that the reverse roller 3 rotates in the reverse direction when two (or more) sheets of paper are fed, as stated above, to prevent double feed.

The construction of this paper feeder is shown, for example, Japanese Utility Model Laid-open Sho 59 No. 187,647 and Japanese Patent Laid-open Sho 63 No. 185,745.

In general, the feed roller 2 and the reverse roller 3 of the paper feeder have a surface of elastic material such as urethane rubber. Accordingly, the surfaces of the rollers 2 and 3 are gradually worn away by their feeding action, thereby lowering the friction coefficients of the rollers. As a result, even when no or one sheet of paper is fed between the rollers 2 and the reverse roller 3 intends to rotate in the direction (arrow a) reverse to the feed direction, so that a misfeed may occur.

As stated above, the reverse roller 3 is urged against the feed roller 2 by means of the spring 4 and the lever 5. If the urging force (contact pressure) is not properly determined, the rollers 2 and 3 will not operate as stated above. For example, if the urging force is too high, the reverse roller 3 will rotate in the feed direction (arrow b) by following the feed roller 2, even though the torque in the reverse direction (arrow a) is transmitted to it. If the urging force is too low, it will be difficult for paper to pass between the rollers 2 and 3, so that a misfeed may occur. Thus, it is necessary to properly determined the contact pressure between the rollers 2 and 3. In the conventional structure, however, the range of the proper contact pressure is narrow and it is thus difficult to adjust the pressure, thereby increasing the costs.

SUMMARY OF THE INVENTION

An object of the present invention is to provide a paper feeder which can prevent defective feed and high costs, as stated above, by improving the rotation control means for the feed roller and the reverse roller, or improving the structure of the reverse roller.

A paper feeder in one aspect of the present invention comprises a feed roller to which forward torque in the feed direction is transmitted; a reverse roller which is urged against the feed roller and rotatable in cooperation with the feed roller, and to which torque opposite to torque in the feed direction is transmitted; and means for transmitting the reverse torque to the reverse roller after a certain time after the forward torque is started which is transmitted to the feed roller.

A paper feeder in another aspect of the present invention comprises a feed roller to which forward torque in the feed direction is transmitted; a reverse roller which is urged against the feed roller and rotatable in cooperation with the feed roller, and to which torque opposite the feed direction is transmitted; means for counting a value which represents the state of wear of the rollers, such as the number of paper sheets which have passed between the rollers, and the number of sheets which have caused jams between the rollers; and means for starting the rollers rotating at the same time when the counted value is equal to or smaller than a predetermined value; and means for transmitting the reverse torque to the reverse roller after a certain time after the forward torque is started being transmitted to the feed roller when the counted value exceeds the predetermined value.

Each of the feeders may further comprises conveying rollers located downstream from the feed roller so as to convey paper in the feed direction; means for stopping the feed roller from rotating in the feed direction when the front end of a paper sheet being conveyed has reached the conveying rollers; and means for keeping the reverse roller rotating after the feed roller is stopped from rotating until the rear end of the sheet being fed has passed between the feed and reverse rollers; and means for stopping the reverse roller from rotating after the sheet rear end passes between the feed and reverse rollers.

A paper feeder in still another aspect of the present invention comprises a feed roller to which forward torque in the feed direction is transmitted; a reverse roller urged against the feed roller and fitted with a torque limiter, which allows the reverse roller to rotate in cooperation with the feed roller when one sheet of paper passes between the rollers, and which causes the reverse roller to rotate reversely to the feed roller when two or more sheets of paper pass between the rollers; and an urging lever with its one end supported pivotably on an urging fulcrum to apply contact pressure to the reverse roller; the fulcrum being located in a position at an angle of about 45° or about 225° clockwise with respect to the plane between the rollers, which is downstream in the feed direction.

A paper feeder in a further aspect of the present invention comprises a feed roller to which forward torque in the feed direction is transmitted; a reverse roller urged against the feed roller; and an urging lever with its one end supported pivotably on an urging fulcrum to apply contact pressure to the reverse roller, the fulcrum being located in a position at an angle except about 135° and about 315° clockwise with respect to the plane between the rollers, which is downstream in the feed direction, and the reverse roller being fitted with a torque limiter, which allows the reverse roller to rotate in cooperation with the feed roller when one sheet of paper passes between the rollers, and which stops the reverse roller from rotating when two or more sheets of paper pass between the rollers.

When each of the feeders starts to feed paper, torque is transmitted to only the feed roller. The feed roller rotates the reverse roller, which follows it, and both rollers convey paper in the feed direction. Thus, at the start of feed, both rollers rotate together in the feed direction, problems such as misfeed do not occur even if the rollers have worn. After the front end of a paper sheet has moved in between the rollers (after a certain time passes), torque in the reverse direction is transmitted to the reverse roller, which then rotates in the reverse direction. Even if two sheets are being fed at the same time, the sheet adjacent to the reverse roller is returned reversely, thereby to prevent double feed.

As stated above, only the feed roller is first rotated to bite a sheet of paper. When a certain time has passed, the reverse roller is rotated. This can prevent misfeed even if the feed and reverse rollers have worn surfaces. In the structure stated above, however, while paper is fed between the feed and reverse rollers, the reverse roller starts to rotate reversely, so that reverse force starts to be applied to the paper. This makes a big noise. Therefore, the feeder may include a counter. Only when the counted value of the counter exceeds a predetermined value, as stated above, only the feed roller is first rotated to bite paper. When a certain time has passed thereafter, the reverse roller is rotated so as to make as little noise as possible. The counter counts a value representing the state of wear of the rollers. Only when the counted value exceeds a predetermined value, the reverse rotation of the reverse roller is delayed. Consequently, the noise does not occur when the rollers have not worn, and misfeed can be prevented when the rollers have worn.

The rotation of the feed roller conveys paper. If the front end of a paper sheet has reached the conveying rollers, the feed roller stops rotating in the feed direction. After this, only the conveying rollers convey the sheet, while at the feed and reverse rollers, only the reverse roller keeps rotating. This, at the feed and reverse rollers, applies only reverse force to the sheet. The reverse force surely returns any sheet which would otherwise be double fed, thereby to prevent double feed. The reverse roller stops after the sheets rear end has completely passed the feed and reverse rollers, thereby to reliably prevent double feed.

FIG. 2A shows the positions where the urging fulcrum of the present invention can be located. As shown, the fulcrum 17 can be positioned within the hatched or shaded area in the vicinity of about 45° or 225° clockwise with the downstream side of the plane P between the feed roller 12 and the reverse roller 13. FIGS. 2B and 2C show examples of location of the fulcrum. In FIG. 2B, the fulcrum 17 is located in a position at about 45°; in FIG. 2C, it is located at about 225°. Such structure can widen the range of urging force of urging means 16 (such as a spring) for gaining proper contact pressure. The reasons for this are explained below.

First, it is assumed that only one sheet of paper is conveyed by the feeder shown in FIGS. 2B and 2C. The then conveying force F1 can be given by the following equation:

$$F_1=\mu_1(f+f_{tr})-TR \quad (1)$$

where $\mu_1$ is the friction coefficient between the feed roller and a sheet of paper; f is the contact pressure; $f_{tr}$ is the contact pressure produced by the torque of the fulcrum and the reverse roller; TR is the torque value of the reverse roller. $f_{tr}$ can be given by the following equation:

$$f_{tr}=TR\times\sin\theta\times\cos\theta \quad (2)$$

where θ is the reverse roller mounting angle.

The equations (1) and (2) lead to the following equation for finding the contact pressure f:

$$f=F_1\times 1/\mu_1+TR(1/\mu_1-\sin\theta\times\cos\theta) \quad (3).$$

Here, in the feeder, if the conveying force $F_1$ of the feed roller 12 is 0, misfeed occurs and no paper can be fed. Accordingly, the contact pressure when $F_1=0$ is the threshold value of misfeed. Therefore, the contact pressure $f_1$ when $F_1=0$ is found to be:

$$f_1=TR(1/\mu_1-\sin\theta\times\cos\theta) \quad (4).$$

Shown in FIG. 3 is the threshold value $f_1$ changing while the mounting angle θ is varied within the range between 0° and 360°.

On the other hand, the reversely conveying force $F_2$ of the reverse roller 13 in the feeder of FIGS. 2B and 2C is given by the following equation:

$$F_2=TR-\mu_3(f-f_{tr}) \quad (5)$$

where $\mu_3$ is the friction coefficient between sheets of paper.

The equations (5) and (2) lead to the following equation for the contact pressure f:

$$f=F_2\times 1/\mu_3+TR(1/\mu_3+\sin\theta\times\cos\theta) \quad (6).$$

Here, if the conveying force $F_2$ of the reverse roller 13 becomes 0, the lower sheet is not returned, so that double feed occurs. Accordingly, the contact pressure when $F_2=0$ is the threshold value of double feed. The contact pressure $f_2$ when $F_2=0$ is found to be:

$$f_2=TR(1/\mu_3+\sin\theta\times\cos\theta) \quad (7).$$

Also shown in FIG. 3 is the threshold value $f_2$ changing while the mounting angle θ is varied within the range between 0° and 360°.

In FIG. 3, the area surrounded by the thresholds of misfeed and double feed is the range of the contact pressure which can be set. As can be found from this figure, the range is wide near where θ is 45° and 225°. Thus, the angle θ is most preferably at about 45° or about 225°, but may be somewhat off these angles. Even if θ is set at about 34°–55° or about 215°–235° with respect to the plane between the feed and reverse rollers, the contact pressure range decreases by about 5% only, as compared with that when θ is 45° or 225°. This is a sufficiently wide range of the contact pressure. In addition, $$TR=Tr\times 10/R \quad (8)$$

where R is the reverse roller radius (mm); Tr is the torque limiter value (gcm).

As stated above, it is preferable that the fulcrum 17 of contact pressure for urging the reverse roller 13 against the feed roller 12 be set at an angle of about 45° or about 225° clockwise with respect to the plane P between the rollers, which is downstream in the feed direction. In the actual apparatus, however, this setting is sometimes not possible due to maintenance or security of the paper conveying path, downsizing of the apparatus, or other problems. As is clear from FIG. 3, however, the farther the angle is off from 45° or 225°, the narrower the contact pressure setting range is, and the more accurate the required adjustment is. This problem is alleviated by the present invention. The reverse roller 13 of the present invention may include a torque limiter, which allows it to rotate in cooperation with the feed roller 12 when one sheet of paper passes between the rollers, and which stops it from rotating when two or more sheets pass between them. The function of this is explained below with reference to FIGS. 4 and 5.

FIG. 4A shows the areas in which the urging fulcrum of the present invention can be positioned. As shown, the fulcrum can be positioned in the hatched areas except for the vicinities of about 135° and about 315° with the downstream side of the plane P between the feed roller 12 and the reverse roller 13. FIGS. 4B and 4C show examples of positioning of the fulcrum 17.

In the feeder with the fulcrum 17 positioned in either of the areas shown in FIG. 4A, the conveying force $F_{11}$ when conveying one sheet of paper is the same as $F_1$ mentioned above, because the reverse roller 13 rotates with the feed roller 12. Therefore, $F_{11}$ is found with the equation (1), and the misfeed threshold $f_{11}$ is also the same.

When two sheets are conveyed, the reverse roller 13 stops rotating, and therefore the reversely conveying force $F_{12}$ is:

$$F_{12}=TR-\mu_3 f \quad (9).$$

Accordingly, in order for $F_{12}$ to be 0 ($F_{12}$ 32 0), the double feed threshold is:

$$f_{12}=TR/\mu_3 \quad (10).$$

The results of the equation (10) and the equation (4) with θ varied between 0° and 360° are as shown in FIG. 5.

As is clear from this figure, in the present invention, if the reverse roller 13 is stopped from rotating, the double feed threshold is constant. As a result, even in an area where the misfeed threshold is high (for example, near 135°), the contact pressure can be set over a wide range, as compared with the case where the reverse roller 13 is rotated. It is preferable, however, to position the fulcrum 17 in an area except for the vicinities of 135° and 315° where the misfeed threshold is high.

DESCRIPTION OF THE PREFERRED EMBODIMENTS

Preferred embodiments of the present invention are described below with reference to the drawings.

Figure 6:
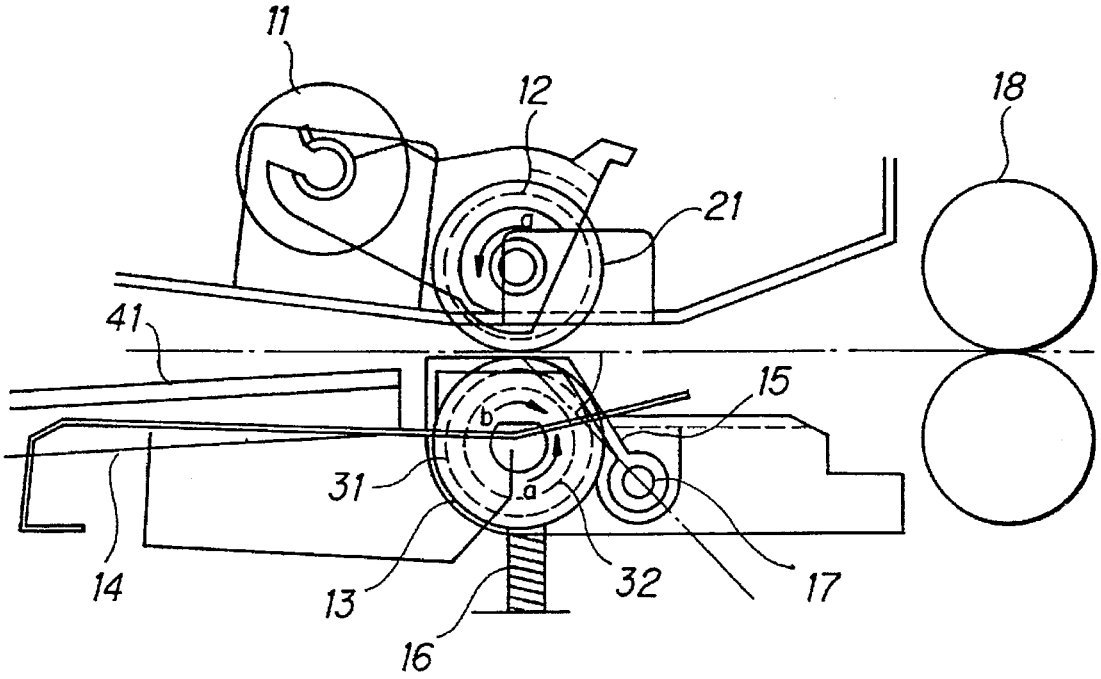
FIG. 6 is a schematic view showing a paper feeder according to an embodiment of the present invention.

FIG. 6 schematically shows a paper feeder for a copying machine, which embodies the present invention.

The feeder includes a pick-up roller 11, a feed roller 12, and a reverse roller 13 paired with the roller 12. The feeder feeds paper 41 from a paper cassette 14.

The feed roller 12 and the reverse roller 13 have a surface of high-friction material such as Norsorex.

Torque is transmitted to the feed roller 12 through a clutch 21 from a drive (not shown) to rotate the roller 12 in the direction of arrow a, which is the direction for feeding the paper 41. The feed roller 12 and pick-up roller 11 are coupled together through a gearing (not shown), so that the feed roller 12 rotates the pick-up roller 11. The clutch 21 is rendered operative, almost at the same time when the feeding starts, to start the rotation in the direction of arrow a.

Torque is transmitted to the reverse roller 13 through a clutch 31 and a torque limiter 32 from a drive (not shown) to apply force to the paper in the direction (arrow a) reverse to the feed direction. The reverse rotation prevents double feed by forcing the lower sheet of paper back to the cassette 41. The torque limiter 32 applies to the reverse roller 13 a constant torque in the reverse direction (arrow a). This torque is set to be smaller than the torque transmitted to the reverse roller 13 from the feed roller 12 through one sheet of paper passing between the rollers 12 and 13, but to be larger than the torque in the feed direction created between two (or more) sheets passing between the rollers 12 and 13. Therefore, the reverse roller 13 acts as follows. When only one sheet of paper is fed between the rollers 12 and 13, the reverse roller 13 rotates in the feed direction (arrow b), against the torque transmitted through the clutch 31, to feed the sheet. When two (or more) sheets are fed at the same time (double fed) between the rollers 12 and 13, the torque mentioned above rotates the reverse roller 13 in the reverse direction (arrow a) to return the lower sheet toward the paper cassette 14.

Figure 1:
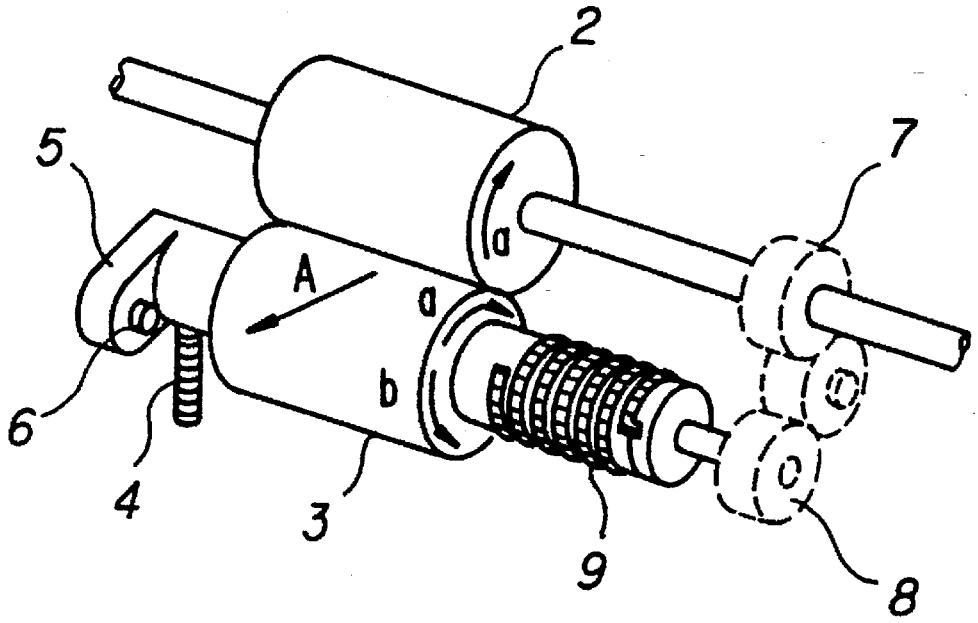
FIG. 1 PRIOR ART
FIG. 1 is a perspective view showing a conventional paper feeder.
Figure 2A:
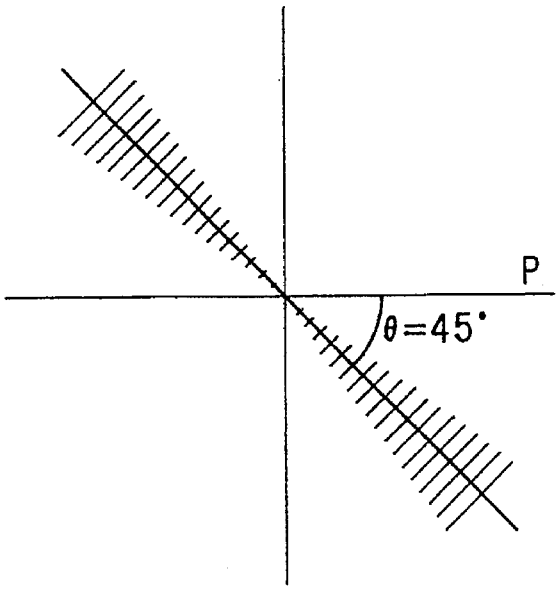
FIG. 2A shows the ranges within which the reverse roller fulcrum is set.
Figure 2B:
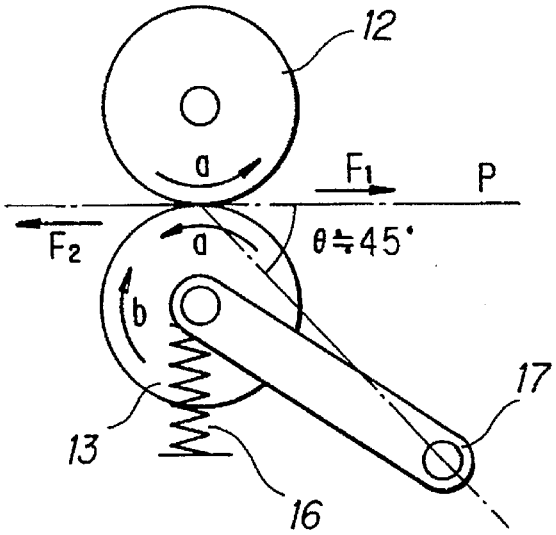
FIG. 2B is a schematic view showing the fulcrum positioned on a line at an angle of 45° with respect to the plane between the feed and reverse rollers, which is downstream in the feed direction.
Figure 2C:
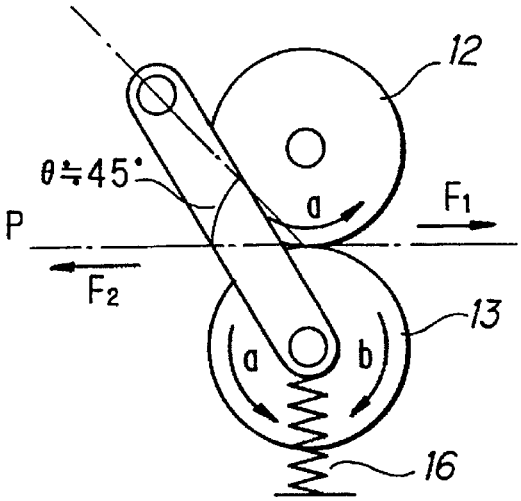
FIG. 2C is a schematic view showing the fulcrum positioned on a line at an angle of 225° with respect to the plane between the feed and reverse rollers, which is downstream in the feed direction.
Figure 3:
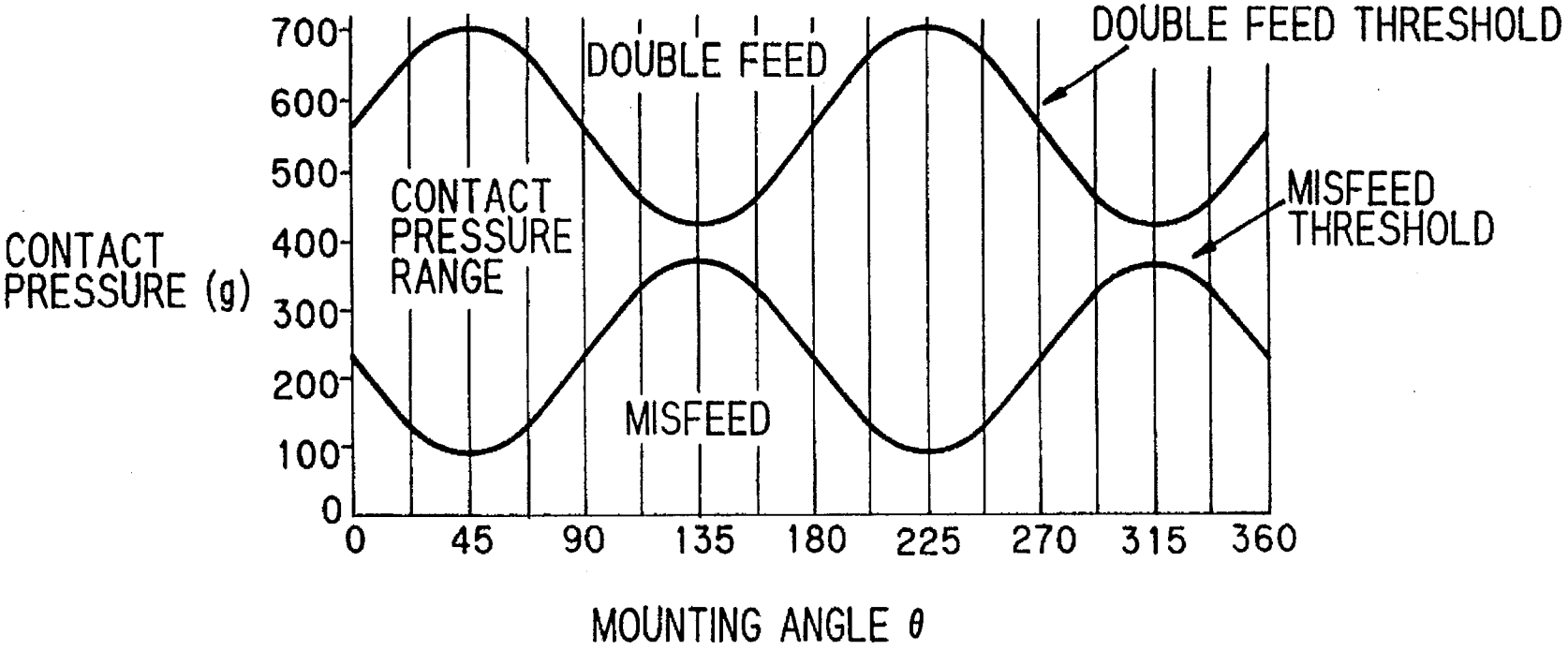
FIG. 3 shows ranges within which the reverse roller contact pressure can be set.
Figure 4A:
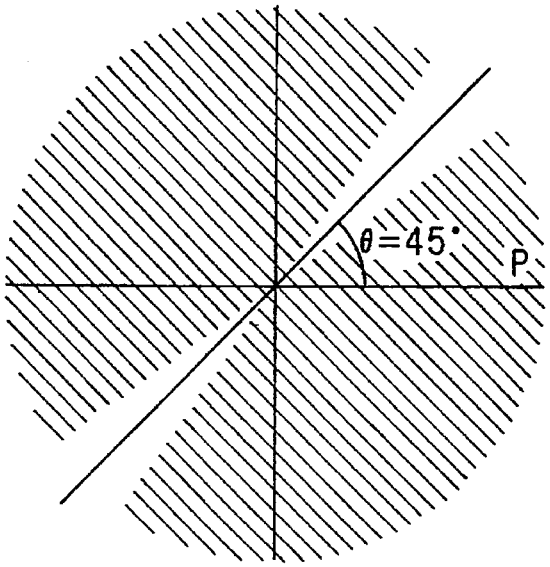
FIG. 4A shows ranges within which the reverse roller fulcrum is set.
Figure 4B:
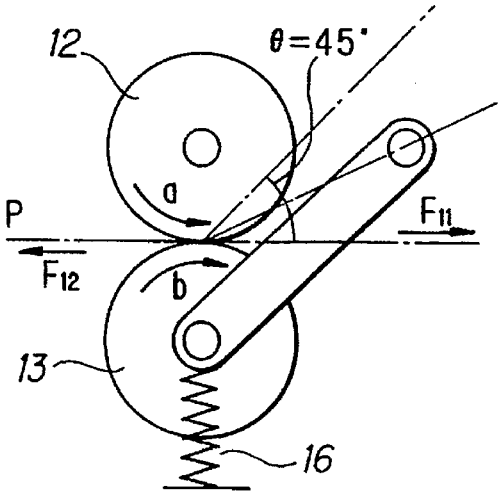
FIG. 4B is a schematic view showing the fulcrum positioned on a line at an angle of 135° with respect to the plane between the feed and reverse rollers, which is downstream in the feed direction.
Figure 4C:
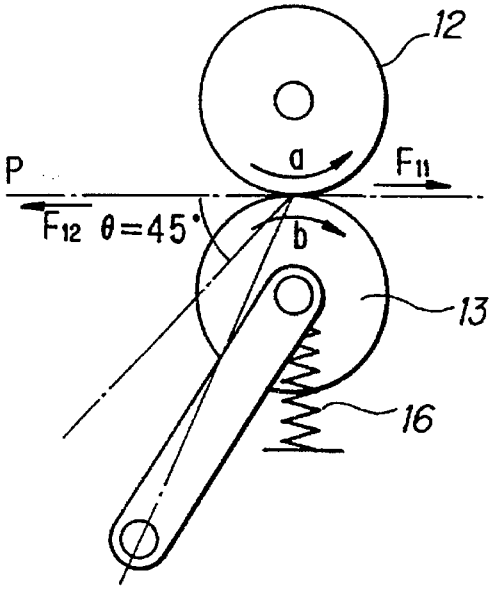
FIG. 4C is a schematic view showing the fulcrum positioned on a line at an angle of 315° with respect to the plane between the feed and reverse rollers, which is downstream in the feed direction.

The reverse roller 13 is urged against the feed roller 12 by an urging mechanism including an urging lever 15 and a compression spring 16. The reverse roller 13 has a shaft supported rotatably by the lever 15, which is supported pivotably around an urging fulcrum 17. The lever 15 is urged by the spring 16 upward, or in such a direction as to lift the reverse roller 13 toward the feed roller 12. In the example of FIG. 6, the fulcrum 17 is positioned on a line at an angle of nearly 45° clockwise with respect to the plane between the feed and reverse rollers, which is downstream in the feed direction. This angle may otherwise be nearly 225°, as stated in the SUMMARY OF THE INVENTION. As shown in FIG. 3, at the angles of 45° and 225°, the contact pressure range is widest, so that misfeed and double feed are not liable to occur.

Figure 5:
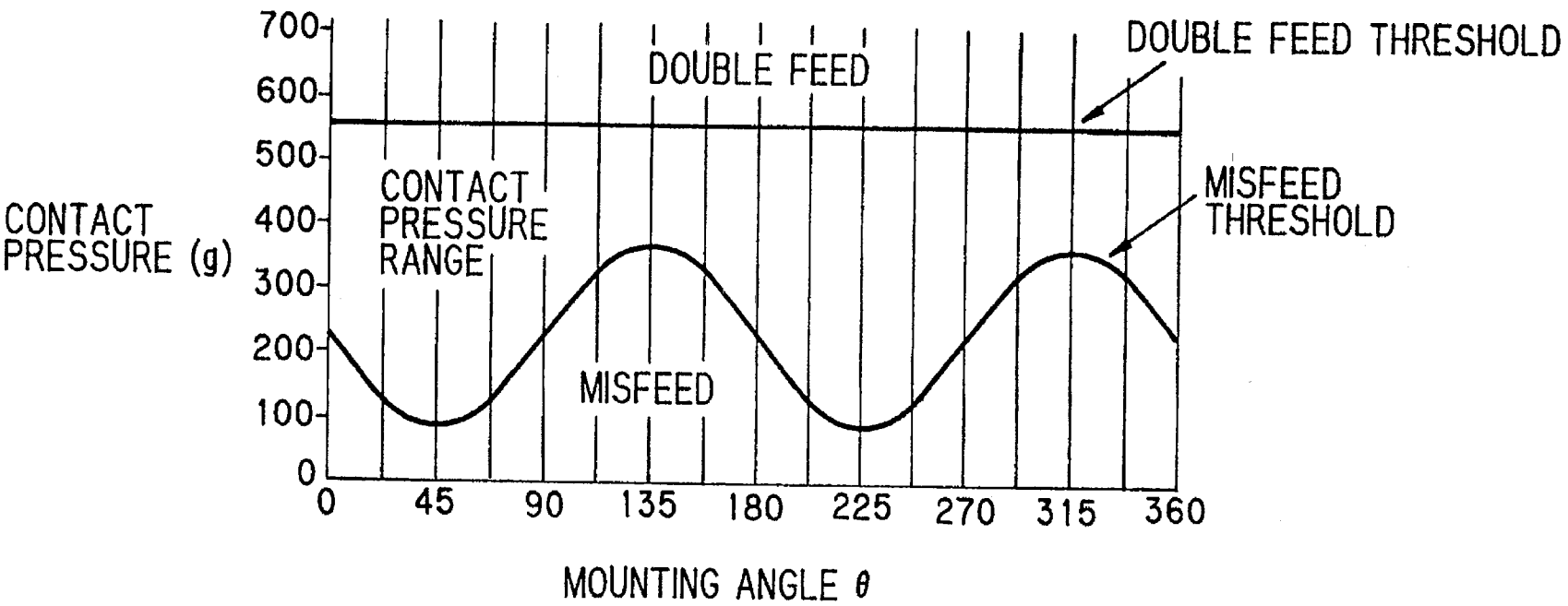
FIG. 5 shows ranges within which the reverse roller contact pressure can be set.
Figure 7:
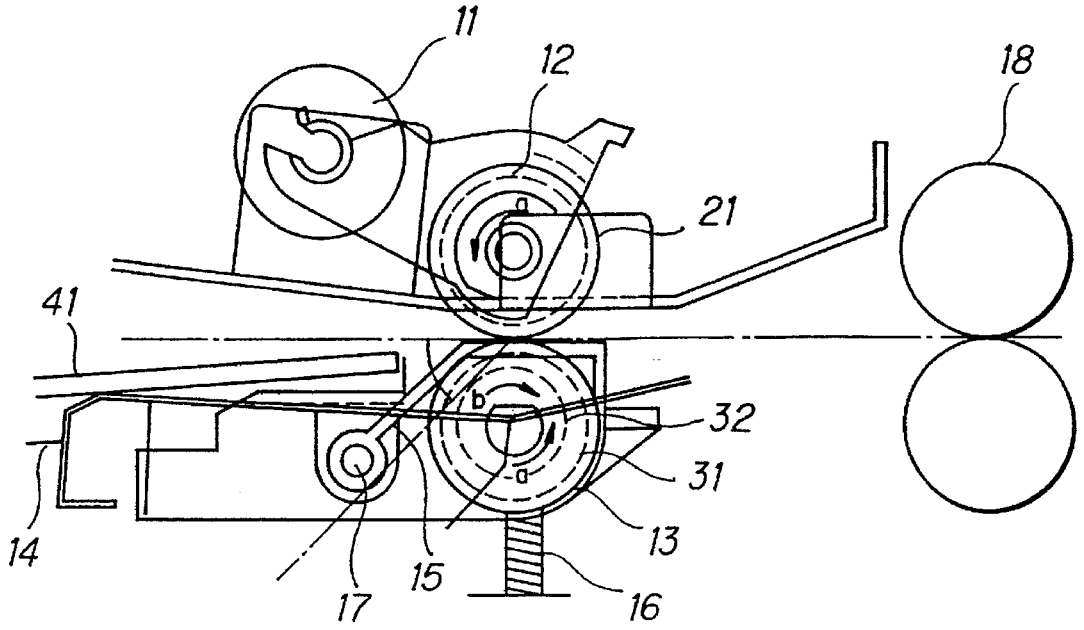
FIG. 7 is a schematic view showing a paper feeder according to another embodiment of the present invention.

If, for reasons of design and the like of the apparatus, it is not possible to locate the fulcrum 17 on a line at an angle of nearly 45° or nearly 225°, it may be located at another position with the reverse roller 13 prevented from rotating reversely to the feed direction. The second embodiment for such structure is shown in FIG. 7, which is different from the structure of FIG. 6 in that the clutch 31 for torque transmission to the reverse roller 13 is rendered inoperative when paper is double fed. This structure makes the reverse roller 13 stop when the paper is double fed. In this case, as shown in FIG. 5, the double feed threshold is maintained at a constant high level. Consequently, whatever angle the fulcrum 17 is set at, the urging force can be set over a wide range. As stated already, however, it is preferable to avoid the setting ranges around 135° and 315° because these ranges are somewhat narrow.

In each of the paper feeders, conveying rollers 18 are located downstream in the feed direction. The conveying rollers 18 are spaced from the feed roller 12 and the reverse roller 13 by a distance shorter than the minimum size of paper which can be conveyed by the feeder. Consequently, while paper is held between the feed roller 12 and the reverse roller 13, its front end can reach the conveying rollers 18.

The following is the control procedure when the feeder feeds paper.

Figure 9:
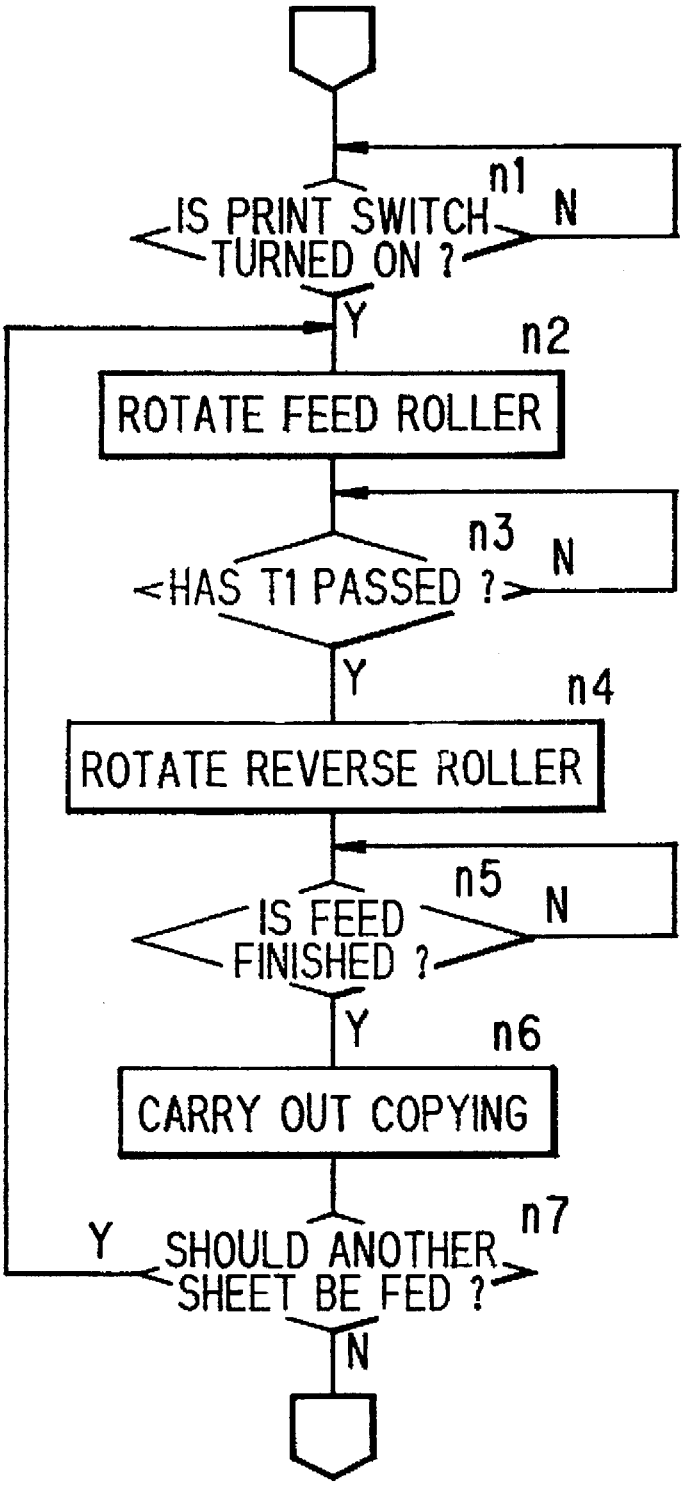
FIG. 9 is a flowchart showing a feeding procedure in the feeder(s)

FIG. 9 is a flowchart showing a feeding procedure to explain the rotation start timing of the reverse roller 13.

When the print switch on the copying machine is pressed, the clutch 21 is first rendered operative, so that the feed roller 12 and the pick-up roller 11 start to rotate in the feed direction (Steps n1 to n2). This rotates the reverse roller 13 in the feed direction, so that paper 41 passes between the feed roller 12 and the reverse roller 13. If a time T1 has passed (Step n3) after the feed roller 12 starts to rotate, the clutch 31 is rendered operative, so that the reverse roller 13 starts to rotate reversely to the feed direction (Step n4). This applies force in the direction reverse to the feed direction to the lower side of the paper being fed. If two (or more) sheets of paper are fed at the same time, the force in the reverse direction returns the lower sheet/s reversely to the feed direction, thereby preventing double feed.

The time T1 is the time taken after the feed roller 12 starts rotating until its rotation causes the paper to be securely bitten or gripped between the feed roller 12 and the reverse roller 13. T1 is shorter than the time T0 after the feed roller 12 starts until a sheet of the smallest size, that can be fed by the feeder, has passed between the rollers 12 and 13. This prevents the paper from being bitten defectively by the rotation of the reverse roller 13. This also prevents double feed by starting the reverse roller rotating before paper of any size has passed over it.

After this, copying is carried out and, if it is necessary to feed another sheet of paper, the feeding is carried out likewise (Steps n5, n6 and n7).

Figure 8:
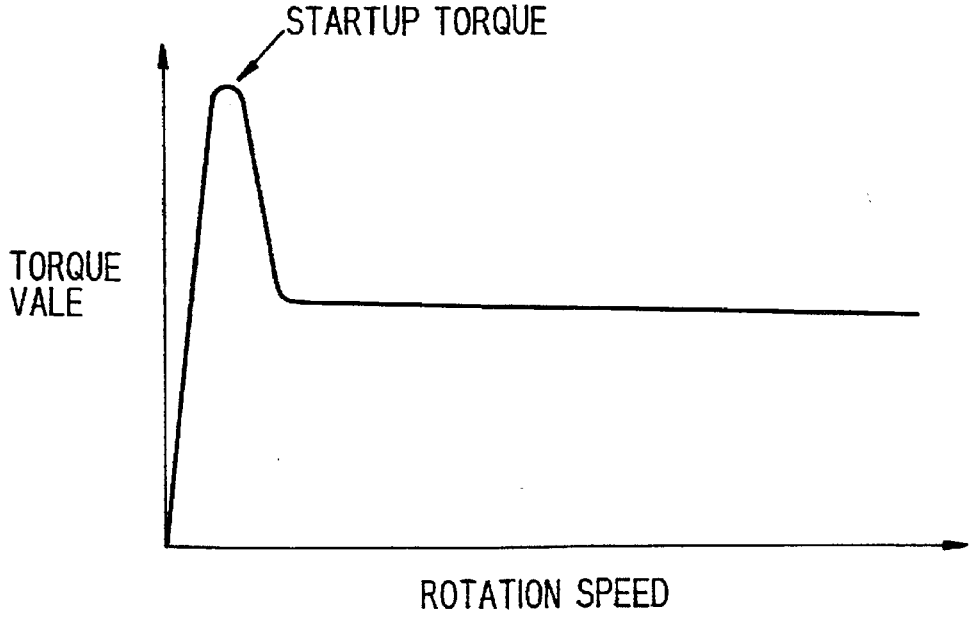
FIG. 8 shows the state of the startup torque of the torque limiter fitted to the reverse roller.

Regarding the action of the torque limiter 32 for the reverse roller 13, when the feed roller 12 starts to rotate at Step n2, this rotates the reverse roller 13 in the feed direction (arrow b), thereby starting the torque limiter 32 rotating. After this, the reverse roller 13 starts to rotate in the reverse direction at Step n4. At this stage, because the torque limiter 32 is already rotating, its startup does not affect the rotation of the reverse roller 13. This results in the advantage of smooth rotation of the reverse roller 13. Startup torque of the torque limiter 32 is shown in FIG. 8.

Figure 10A:
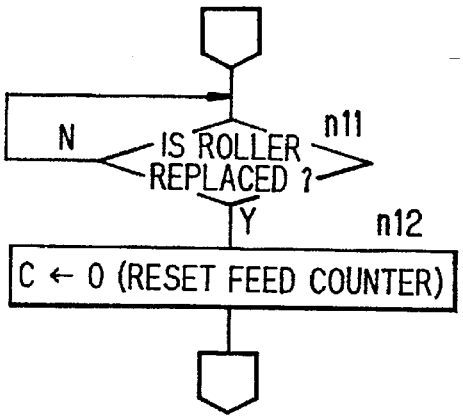
FIG. 10A is a flowchart showing a feeding procedure up to n12 in the feeder(s)
Figure 10B:
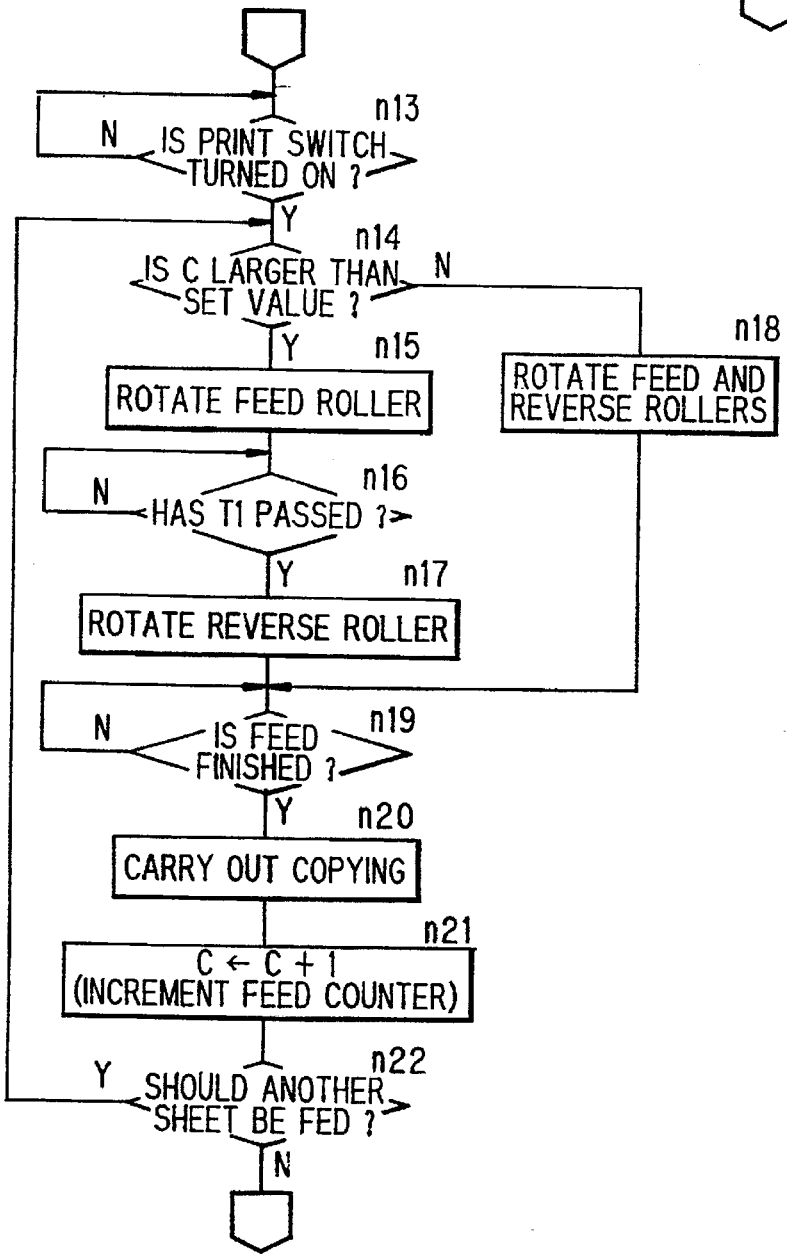
FIG. 10B is a flowchart showing a feeding procedure from n13 in the feeder(s)

FIGS. 10A and 10B are flow charts showing another feeding procedure to explain the determination of whether to rotate the reverse roller 13.

Execution of this procedure requires a feed counter for counting the number of sheets of paper fed. In the present embodiments, the feed counter is the counter for counting the number of copies when copying is carried out. Otherwise, the feed counter may be a counter or the like for mechanically counting the number of sheets fed actually.

The feed counter C is cleared or reset when the feed roller 12 or the reverse roller 13 is replaced (Steps n11 to n12).

According to the feeding procedure, when the print switch is operated, the value of the feed counter C is first compared with a predetermined value (Steps n13 to n14). The predetermined value is the number of paper sheets which can be fed until the feed roller 12 or the reverse roller 13 wears to lower its feeding performance. Therefore, if the feed counter C value is equal to or smaller than the predetermined value, the feed roller 12 and the reverse roller 13 are started rotating at the same time to feed paper (Step n18). In this case, it is assumed that the rollers 12 and 13 have not worn away, so that no misfeed occurs.

If the feed counter C value exceeds the predetermined value, the feed roller 12 is first started rotating and, when a certain time T1 has passed, the reverse roller 13 is started rotating (Steps n15, n16 and n17), similarly to the procedure of FIG. 9. This prevents misfeed even though the feed roller 12 or the reverse roller 13 has worn away.

If paper has been fed, copying is carried out, and the feed counter C is incremented (Steps n19, n20 and n21). Then, if another sheet should be fed, the feeding for it is carried out (Steps n22 to n14).

Figure 11A:
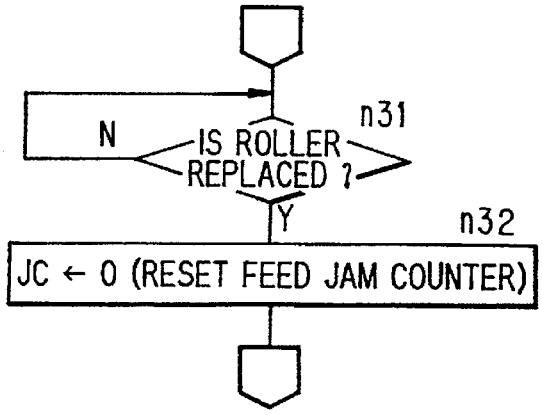
FIG. 11A is a flowchart showing a feeding procedure up to n32 in the feeder(s)
Figure 11B:
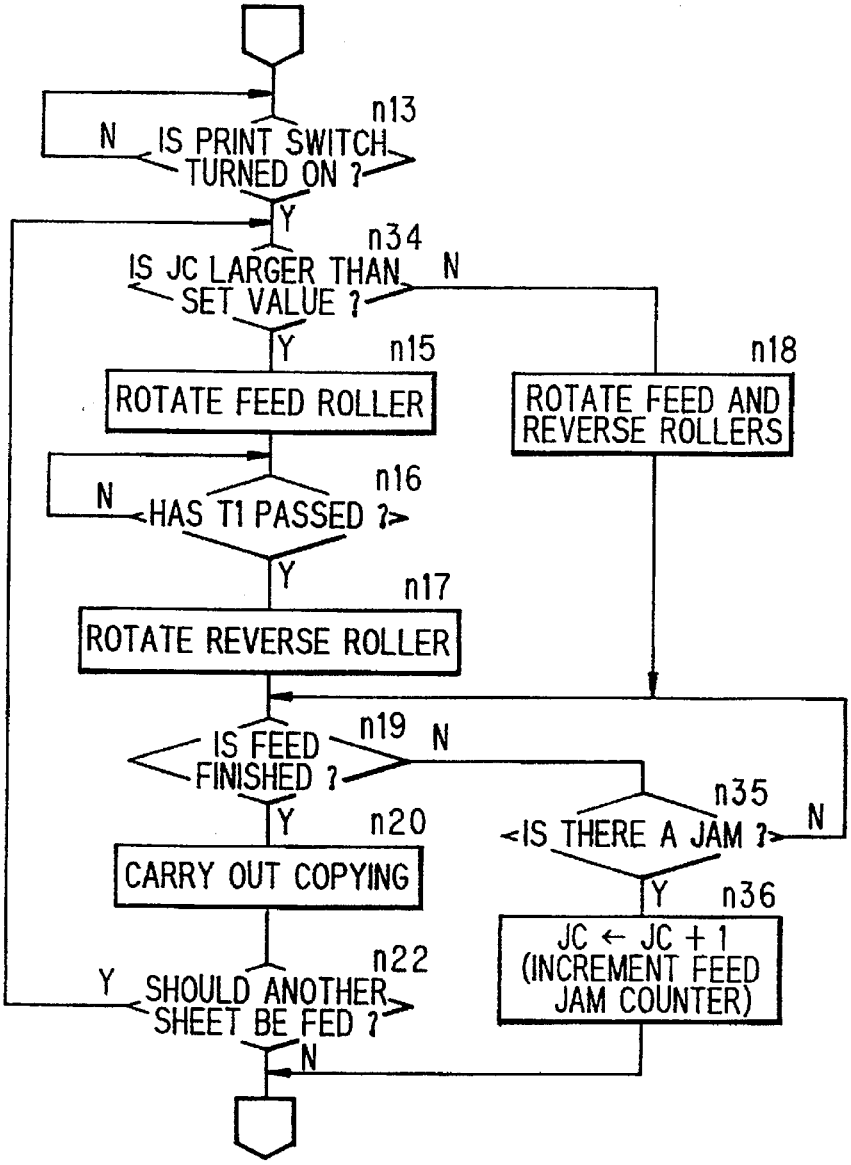
FIG. 11B is a flowchart showing a feeding procedure from n13 in the feeder(s)

FIGS. 11A and 11B show still another procedure.

In the above embodiment, the number of all sheets fed is counted, and the rotation start timing for the reverse roller 13 is changed according to the counted number. In this embodiment, this timing is changed according to the number of sheets jammed during the feed. If the feed roller 12 or the reverse roller 13 has worn away, feed jams are liable to occur. The number of sheets jammed is counted. If the number has become large, the feed roller 12 or the reverse roller 13 is judged to have worn away, and the rotation start timing for the reverse roller 13 is delayed.

The feed jam counter JC is reset when the feed roller 12 or the reverse roller 13 is replaced (Steps n31 to n32).

If the print switch is operated, the value of the jam counter JC is compared with a predetermined value (Steps n13 to n34). The predetermined value is about the number of sheets at which the feed roller 12 or the reverse roller 13 can be judged to have worn away. If the jam counter JC value is equal to or smaller than the predetermined value, the feed roller 12 and the reverse roller 13 are started rotating at the same time to feed paper. If the JC value exceeds the predetermined value, the feed roller 12 is rotated in advance to take in paper, and thereafter the reverse roller 13 is rotated (Steps n15, n16 and n17).

If a jam occurs during the feed, the jam counter JC is incremented, and the number of feed jams is stored (Steps n35 to n36). When paper has been fed, copying is carried out and, if it is necessary to feed another sheet, the procedure returns to the feeding (Steps n20 to n22).

Still another embodiment is explained below.

Figure 12:
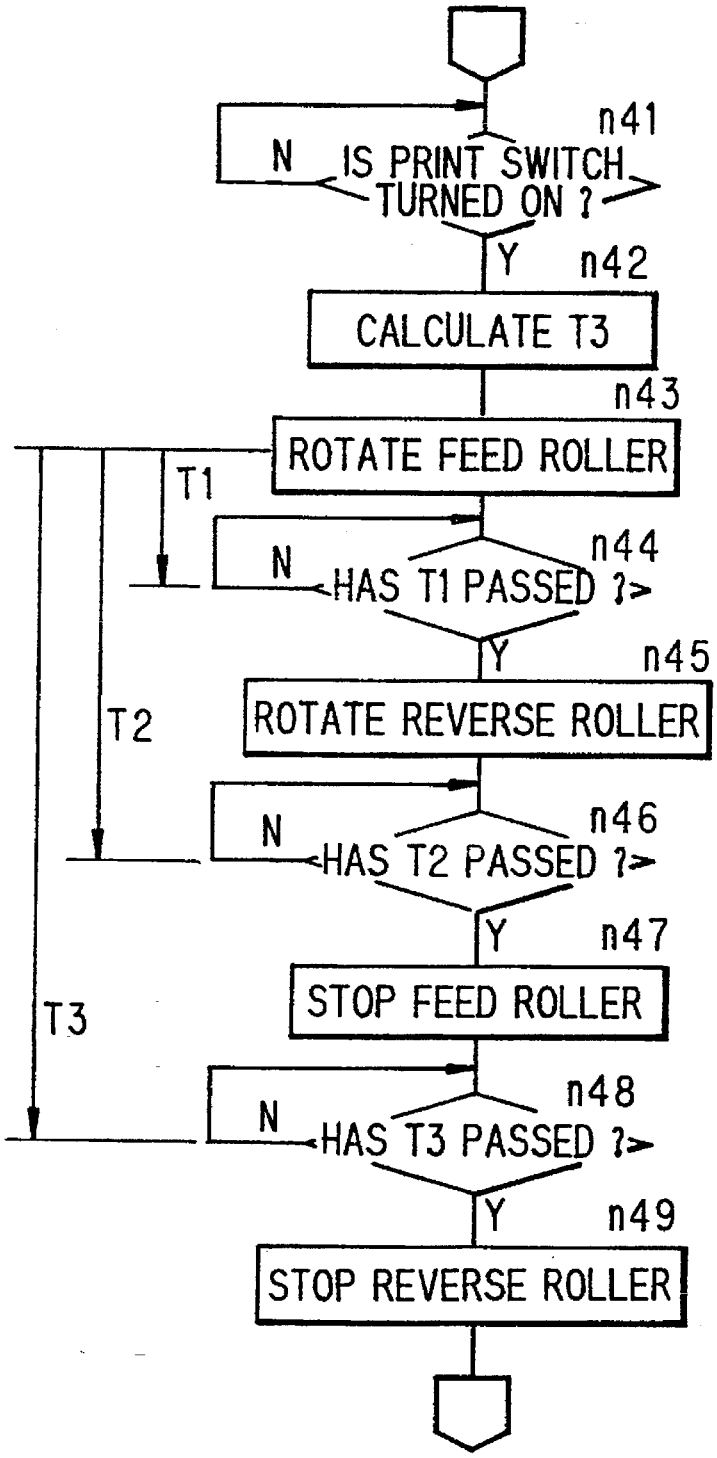
FIG. 12 is a flowchart showing a feeding procedure according to the present invention.
Figure 13:
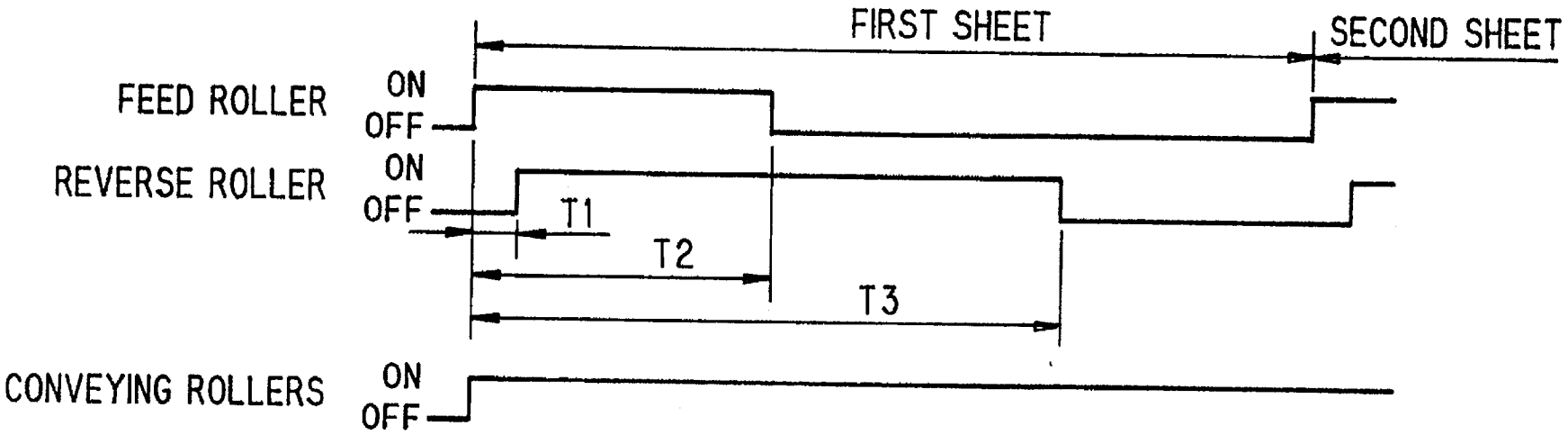
FIG. 13 is a timing chart showing the procedure.

FIG. 12 is a flowchart showing a feeding procedure for this embodiment and FIG. 13 is a timing chart during the feeding, for explaining the rotation stop timing for the reverse roller.

This procedure involves timer elapse times T1, T2 and T3. As stated above, T1 is the time after the feed roller 12 is started rotating until the reverse roller 13 is started rotating, when the rotation of the feed roller 12 has caused a sheet of paper to be surely bitten between the feed roller 12 and the reverse roller 13. Also, T1 is shorter than the time T0 after the feed roller 12 starts until a sheet of the smallest size, which can be fed in this feeder, has passed between the rollers 12 and 13. This prevents paper from being defectively bitten with the rotation of the reverse roller 13. This also prevents paper of any size from being double fed by starting the reverse roller rotating reversely before the paper has passed over.

T2 is the time after the feed roller 12 starts rotating until it stops. T2 corresponds to the time after the feed roller 12 starts rotating until the front end of paper has reached the conveying rollers 18. After the paper front end reaches the conveying rollers 18, they convey the paper, so that the feed roller 12 may be stopped without problems.

T1 and T2 are times fixed dependently on the apparatus.

T3 is the time until the reverse roller 13 is stopped, and the timing may be started when either the feed roller 12 or the reverse roller 13 starts rotating. It is essential to time the period until the rear end of the paper being conveyed has passed between the feed roller 12 and the reverse roller 13. T3 depends on the size of paper fed, is short for small sizes and is long for large sizes. T3 is calculated and set according to the size of paper fed per printing process. The size of paper fed is detected automatically in most of the recent copying machines and laser printers. It is therefore possible to calculate, with the paper size detected automatically, the time T3 until the paper rear end has passed between the feed roller 12 and the reverse roller 13. This can be found with the following equation:

$$T3=L/V+T1+\alpha \quad (11)$$

where L is the paper length (found with the length in the paper feed direction and/or the paper size); V is the paper conveying speed; $\alpha$ is an arbitrary time for dispersion.

The feeding procedure is explained below.

When the print switch is operated, T3 is first calculated with the size of paper fed, and the feed roller 12 is started rotating to feed paper (Steps n41, n42 and n43). The conveying rollers 18 are also started rotating simultaneously with the feed roller 12. When T1 has passed thereafter, the reverse roller 13 is started rotating to prevent double feed (Steps n44 to n45). Consequently, the paper is fed without double feed. If it is determined by the elapse of T2 that the paper front end has reached the conveying rollers 18, the feed roller 12 is stopped, and thereafter only the conveying rollers 18 convey the paper (Steps n46 to n47). Because the reverse roller 13 keeps rotating thereafter, the sheet of paper being conveyed does not drag the succeeding sheet, so that no double feed occurs. If it is determined by the elapse of T3 that the paper rear end has passed between the feed roller 12 and the reverse roller 13, the reverse roller is stopped to end the feed of one sheet (Steps n48 to n49). After this, the sheet is conveyed by the conveying rollers 18 and the succeeding rollers.

Figure 14:
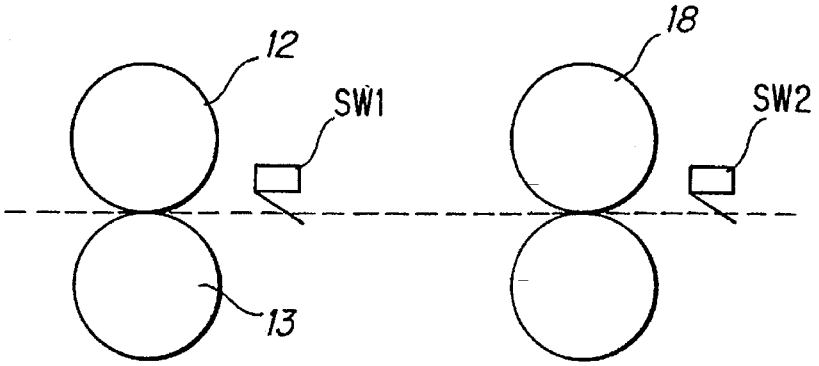
FIG. 14 is a schematic view showing another paper feeder according to the present invention.

In the above embodiment, a timer is used to control the rotation of the feed roller 12 and the reverse roller 13. Otherwise, the rollers 12 and 13, etc. may be controlled with the output of sensors for paper detection, which are located in the paper conveying path. FIG. 14 shows an arrangement of paper detection sensors SW1 and SW2 in the paper conveying path. The sensor SW1 is located immediately in the rear of the feed roller 12 and the reverse roller 13. The sensor SW2 is located immediately in the rear of the conveying rollers 18. The sensors SW1 and SW2 may each be a microswitch, a light sensor or the like for detecting the passing state of paper. Actually used as the detected values from the sensors SW1 and SW2 are changes of the detected states. The passage of the paper front end is judged by the change from absence of paper (OFF) to presence of paper (ON). The passage of the rear end is judged by the change from ON to OFF.

Figure 15:
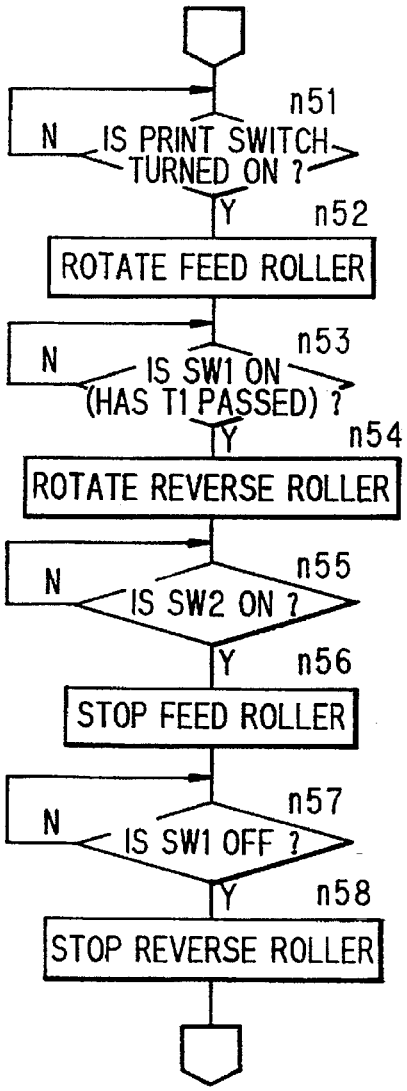
FIG. 15 is a flowchart showing a feeding procedure in the feeder.
Figure 16:
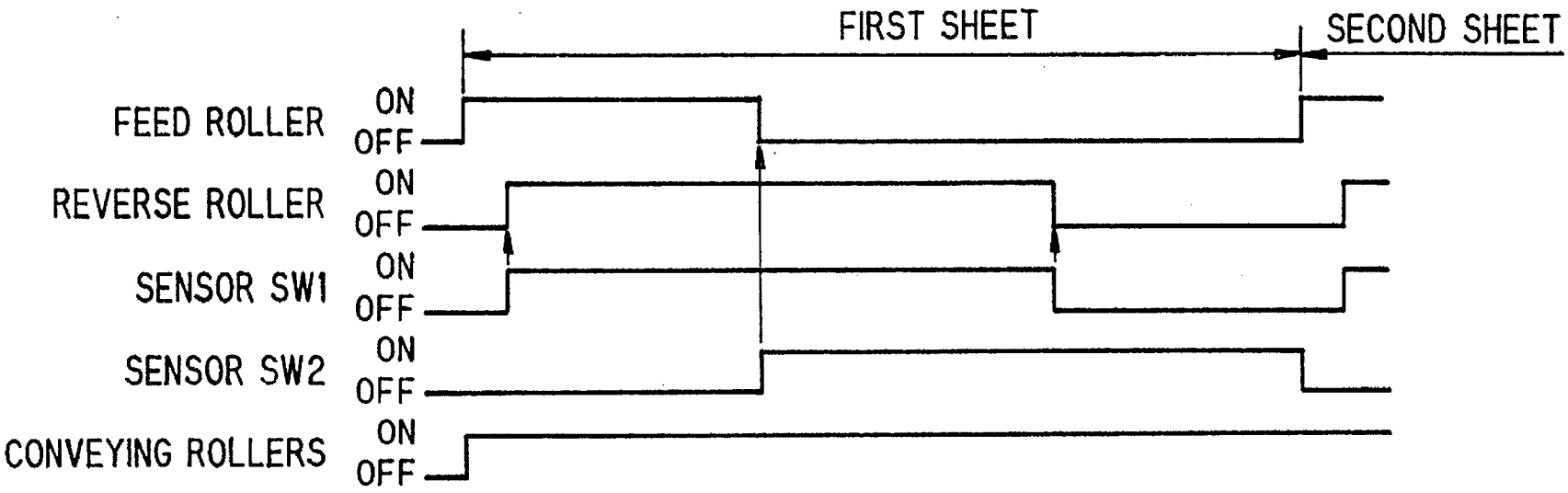
FIG. 16 is a timing chart showing the procedure.

The feeding procedure using the sensors is explained below. FIG. 15 is a flowchart showing the procedure. FIG. 16 is a timing chart for the process.

When the print switch is operated, the feed roller 12 starts rotating (Steps n51 to n52). If the sensor SW1 detects the front end of a paper sheet, which is securely bitten between the feed roller 12 and the reverse roller 13, then the reverse roller 13 is started rotating to start prevention of double feed (Steps n53 to n54). Next, when the sensor SW2 detects the sheet front end to judge that the end has reached the conveying rollers 18, the feed roller 12 is stopped and the conveying rollers 18 convey the sheet thereafter (Steps n55 to n56). The reverse roller 13 keeps rotating thereafter to prevent double feed. The reverse roller 13 is stopped when the sheet rear end passes the sensor SW1 to judge that the end has passed between the feed roller 12 and the reverse roller 13 (Steps n57 to n58).

In the embodiments of FIGS. 9 and 11, the reverse roller 13 is started rotating when the time T1 has passed, but it may otherwise be started by detecting the sheet front end with a paper detection sensor SW1.

More reliable methods of preventing double feed are explained below. One of the methods is to prevent double feed with both feed roller 12 and the reverse roller 13, by rotating the rollers in the reverse directions, respectively, after the sheet front end is bitten between the conveying rollers 18 and the conveying stabilizes.

Figure 17:
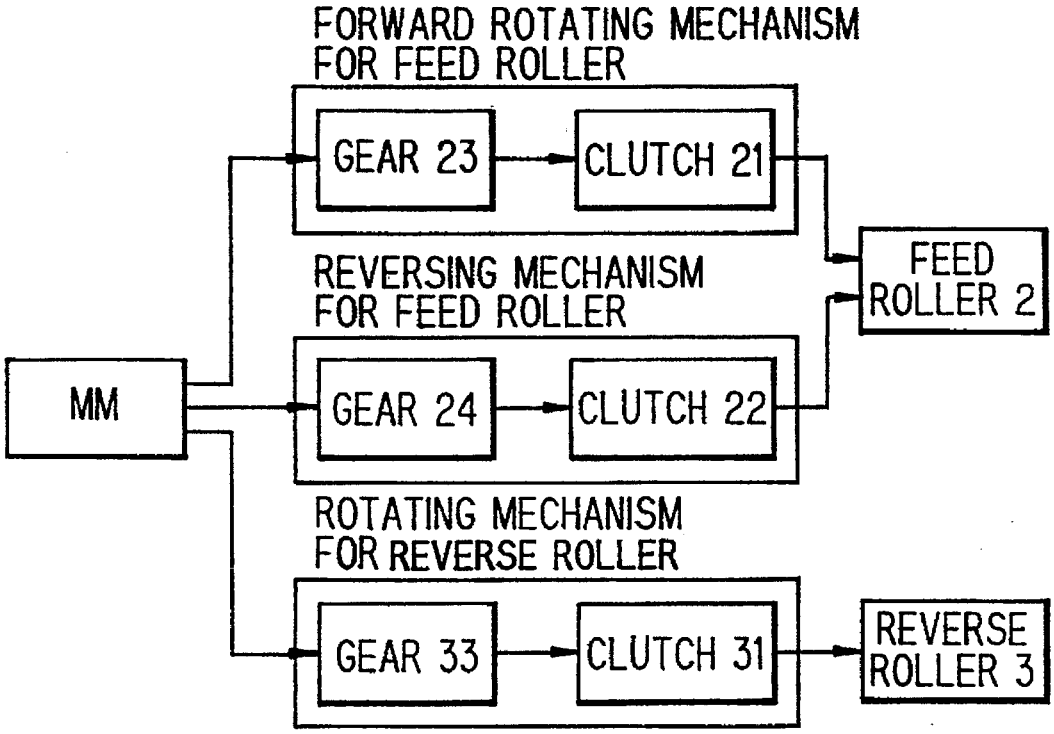
FIG. 17 is a block diagram showing still another paper feeder according to the present invention.

FIG. 17 is a block diagram of the drive system of a paper feeder for carrying out this method. Driving force generated from a main motor MM is transmitted to the feed roller 12 and the reverse roller 13. Driving force is transmitted to the feed roller 12 through two routes. One of the routes runs through a gear 23 and a clutch 21 to rotate the feed roller 12 in the feed direction (arrow a in FIGS. 6 and 7). The other route runs through a gear 24 and a clutch 22 to rotate the feed roller 12 in the reverse direction (reversely to arrow a in FIGS. 6 and 7). When the feed roller 12 rotates in this direction, paper is forced back toward the cassette 14. Driving force is transmitted to the reverse roller 13 through a gear 33 and a clutch 31 from the motor MM. This rotates the roller 13 in the direction of arrow a in FIGS. 6 and 7 to force the paper back toward the cassette 14.

Figure 18:
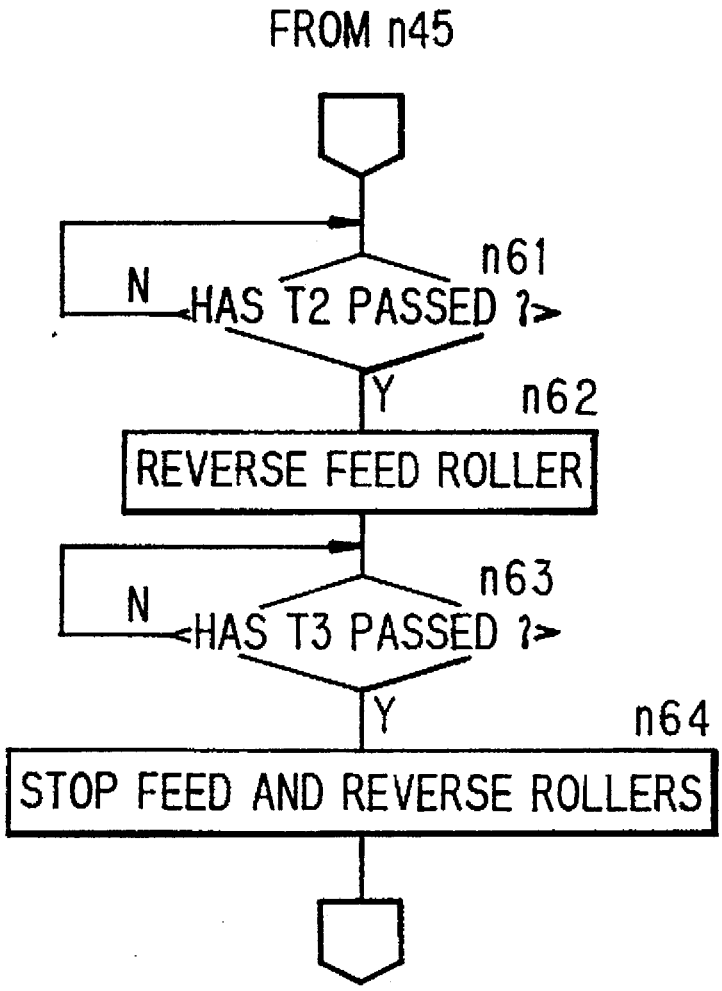
FIG. 18 is a flowchart showing a feeding procedure in the feeder.
Figure 19:
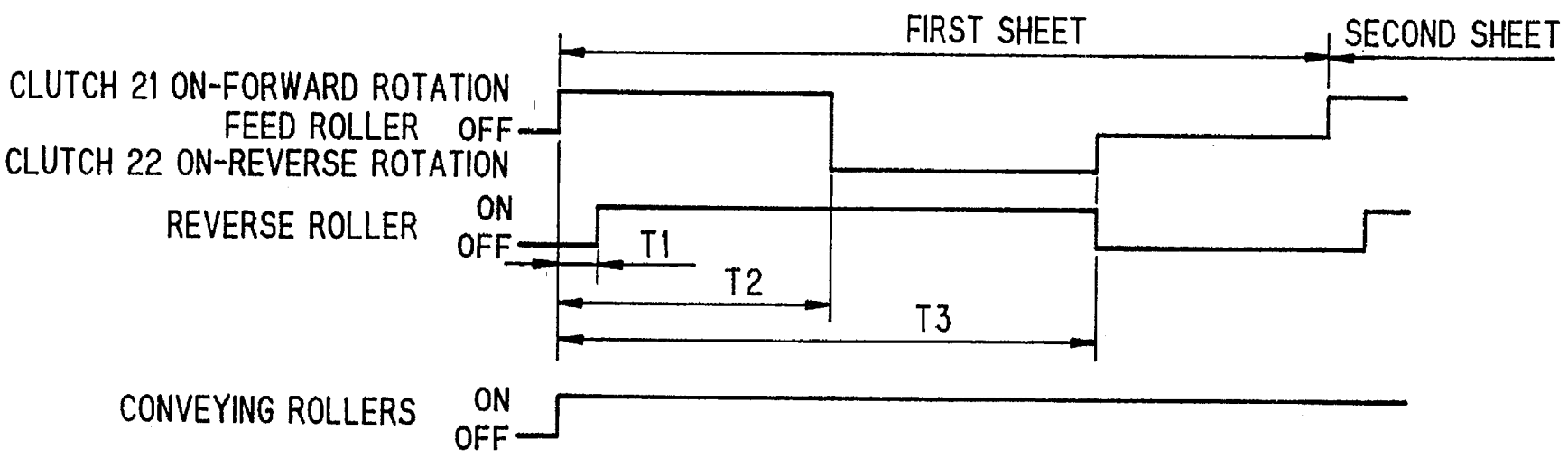
FIG. 19 is a timing chart showing the procedure.
Figure 20:
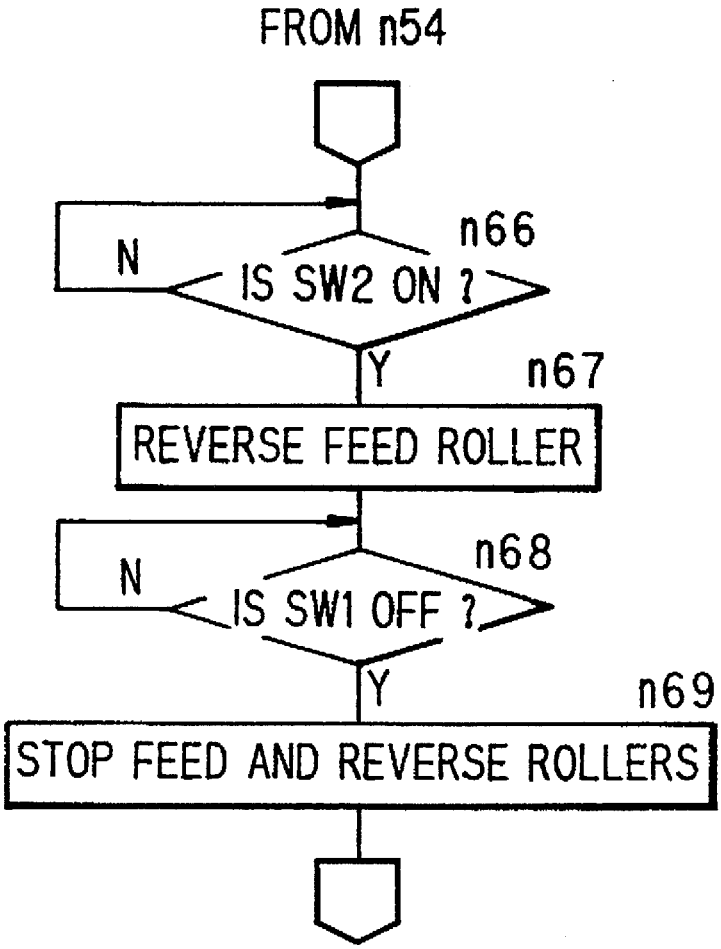
FIG. 20 is a flowchart showing another feeding procedure in the feeder of FIG. 17.
Figure 21:
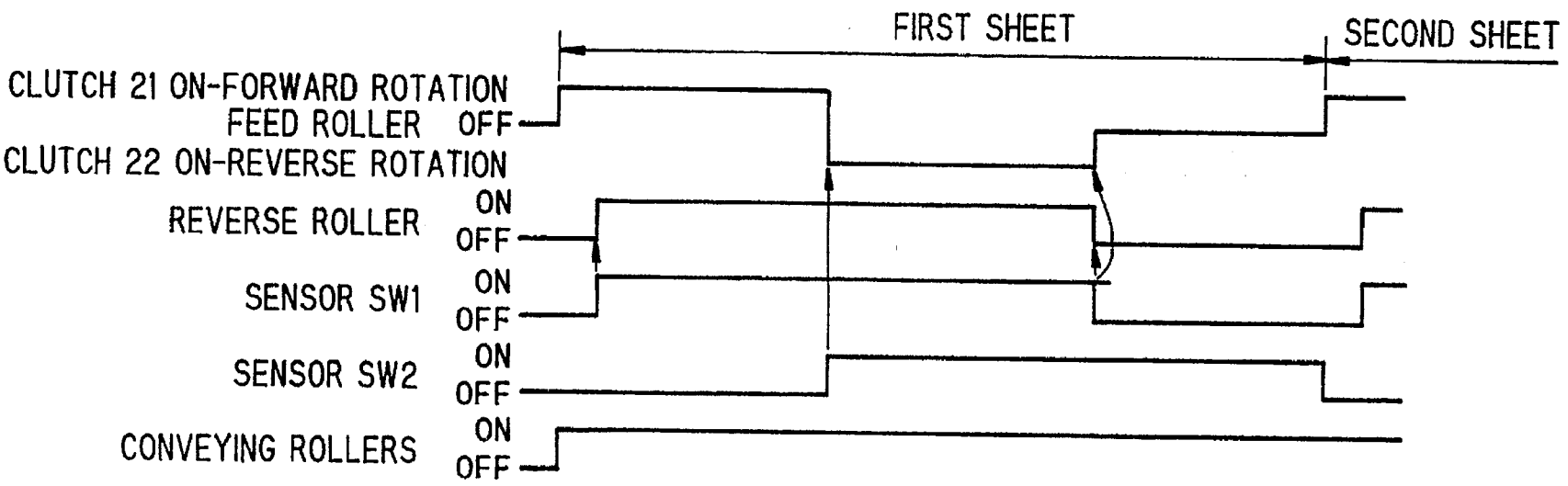
FIG. 21 is a timing chart showing the procedure.

The feeding procedure by the feeder constructed as stated above is explained below. FIGS. 18 and 19 are a flowchart and a time chart, respectively, showing the feeding procedure for timer control. FIGS. 20 and 21 are a flowchart and a time chart, respectively, showing the feeding procedure for control with the paper detection sensors SW1 and SW2.

FIGS. 18 and 19 are first referred to. The procedure until the feed roller 12 and the reverse roller 13 are started rotating is similar to FIGS. 12 and 13. At this stage, the feed roller 12 is rotated in the feed direction by the driving force transmitted from the motor MM through the gear 23 and the clutch 21. If a time T2 has passed, the drive system for the feed roller 12 is switched. This is done by rendering the clutch 21 inoperative and the clutch 22 operative, thereby to transmit the driving force from the motor MM through the gear 24 and the clutch 22. This rotates the feed roller 12 in the reverse direction to force any sheet, which would otherwise be double fed, back toward the paper cassette 14 (Steps n61 to n62). At this stage, the front end of the sheet being fed has already reached the conveying rollers 18, which convey the sheet, so that the sheet is not forced back toward the paper cassette 14. The condition for this is that the forward conveying force of the conveying rollers 18 is set to be larger than the reverse conveying force of the feed roller 12 and the reverse roller 13. A specific example is explained below.

On the assumption that the fulcrum of the reverse roller 13 is set at the angle of 45° as shown in FIG. 6, the force Fr at which a sheet of paper is conveyed when the feed roller 12 is reversed is: $Fr=\mu_1\ (f+TR\times\sin\theta\times\cos\theta)+tm$ (12).

In this case, θ is 135° as the conveying direction is reversed. For example, if $\mu_1=1.3$, f=300 g, then Fr=195 g.

If the force Fh at which the conveying rollers 18 convey a sheet of paper is set to be larger than the conveying force Fr when the feed roller 12 is reversed, a sheet being fed is not pulled back, and also the reversely rotating the feed roller 12 prevents double feed of sheets. The conveying force Fh with the conveying rollers 18 is normally set at about 1,000 g. This meets the condition of Fr<Fh.

If the time T3 is up after the feed roller 12 is reversed as stated above, both feed roller 12 and the reverse roller 13 are stopped (Steps n63 to n64).

Next, FIGS. 20 and 21 are referred to. The procedure until the feed roller 12 and the reverse roller 13 are started rotating is similar to FIGS. 15 and 16, with the feed roller 12 rotated in the feed direction by the driving force transmitted from the main motor MM through the gear 23 and the clutch 21. If the sheet front end has reached the paper detection sensor SW2, the clutch 21 for the feed roller 12 is rendered inoperative and the clutch 22 is rendered operative, thereby to change the direction of rotation of the feed roller 12 from forward to reverse (Steps n66 to n67). This makes both feed roller 12 and the reverse roller 13 act to prevent double feed. After this, if the rear end of the sheet being fed has passed the paper detection sensor SW1, both feed roller 12 and the reverse roller 13 are stopped to end the sheet feed (Steps n68 to n69).

The effectiveness of double feed prevention can be improved by increasing the conveying force F2 reverse to the feed direction with the following method, other than the reverse rotation of the feed roller 12 as stated above.

When two sheets of paper are conveyed at the same time between the feed roller 12 and the reverse roller 13, the conveying force $F_2$ in the reverse direction for returning the sheet adjacent to the reverse roller toward the paper cassette 14 is, from (5) and (2):

$$F_2=TR-\mu_3(f-TR\times\sin\theta\times\cos\theta) \quad (13).$$

Meanwhile, the conveying force $F_1$ of the feed roller 12 when one sheet is conveyed is, from (1) and (2):

$$F_1=\mu_1(f+TR\times\sin\theta\cos\theta) \quad (14).$$

These equations show that the conveying force $F_2$ in the reverse direction increases, while the conveying force $F_1$ in the feed direction decreases, by (1) decreasing f (contact pressure), (2) increasing TR (torque value of the reverse roller 13), or (3) setting θ (angle at which the reverse roller 13 is mounted) at a value off 45°. Therefore, when a sheet being fed has reached the conveying rollers 18, so that the feed of the sheet has become sure, any of (1)–(3) stated above is carried out to increase the effectiveness of double feed prevention thereafter. Examples of structure therefor are explained below.

First, the structure for decreasing the contact pressure f (1) is explained.

Figure 22:
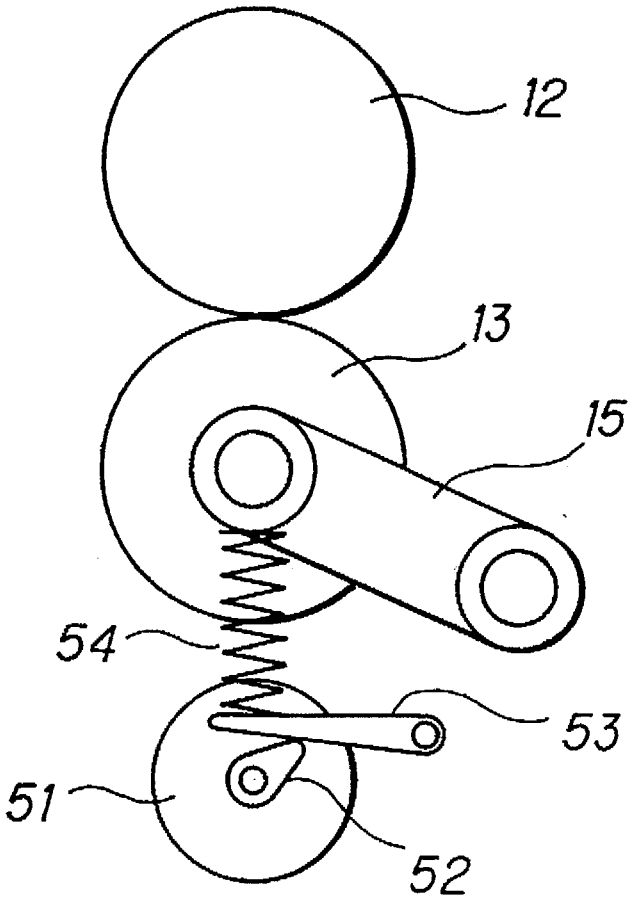
FIG. 22 is a schematic view showing yet another paper feeder according to the present invention.

FIG. 22 shows a schematic structure of the essentials of a paper feeder. The feed roller 12 and the reverse roller 13 are paired together. The reverse roller 13 is supported by an urging lever 15 urged upward by a spring 54. The structure stated so far is similar to that shown in FIG. 6. The lower end of the spring 54 is supported by a pivotable lever 53. The lower surface of the lever 53 engages with a cam 52 rotated by a pulse motor 51. The rotation of the cam 52 with the motor 51 makes the lever 53 pivot upward or downward. This varies the contact pressure on the urging lever 15 of the reverse roller 13, thereby to change the contact pressure f between the feed roller 12 and the reverse roller 13.

Figure 23:
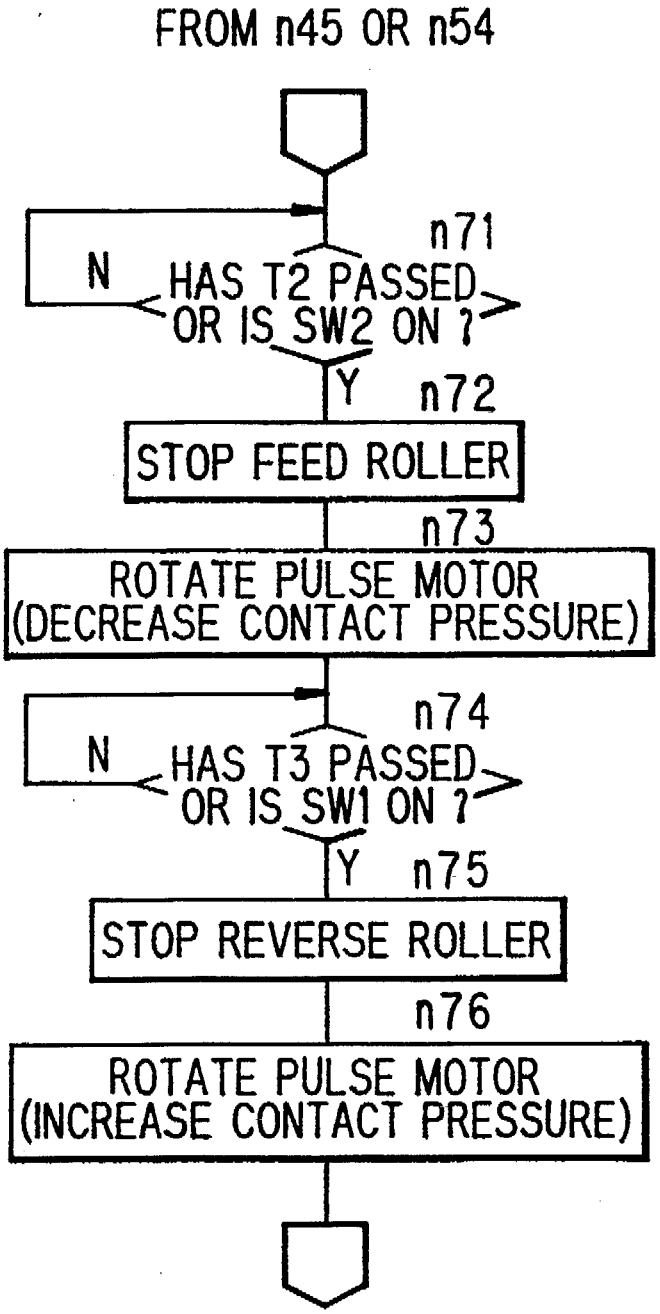
FIG. 23 is a flowchart showing a feeding procedure in the feeder.
Figure 24:
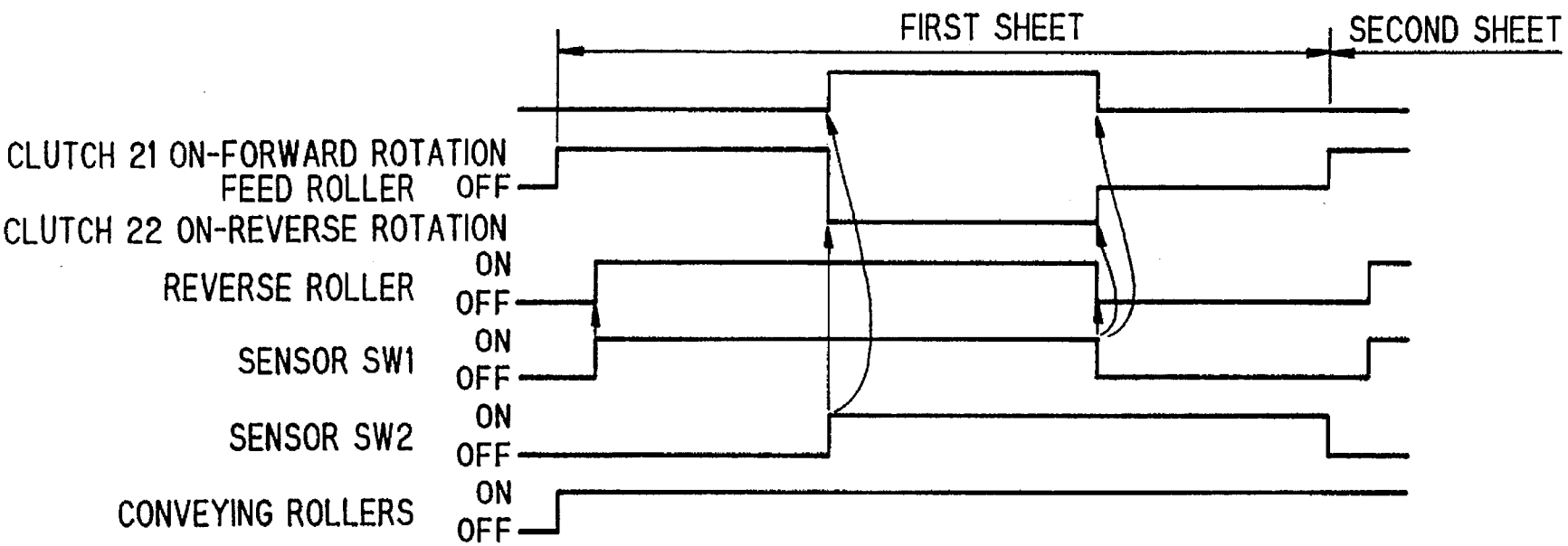
FIG. 24 is a timing chart showing the procedure.

The feeding procedure with the feeder constructed as stated above is explained below. FIGS. 23 and 24 are a flowchart and a timing chart, respectively, which show the procedure. The rotation of the feed roller 12 and the reverse roller 13 feeds a sheet of paper. If the sheet front end has reached the conveying rollers 18, only these rollers can convey the sheet thereafter, and therefore the feed roller 12 is stopped (Steps n71 to n72). At the same time, the pulse motor 51 is rotated so as to lower the force urging the reverse roller 13 against the feed roller 12 (Step n73). This increases the conveying force $F_2$ in the reverse direction with the reverse roller 13, thereby to improve the effectiveness of double feed prevention. If the sheet has completely passed over between the feed roller 12 and the reverse roller 13, the reverse roller 13 is stopped rotating, and the contact pressure of the reverse roller 13 is returned to its original state, thus ending the feed of one sheet (Steps n74, n75 and n76).

The structure for increasing the reverse roller 13 torque value TR (2) is explained below.

Figure 25:
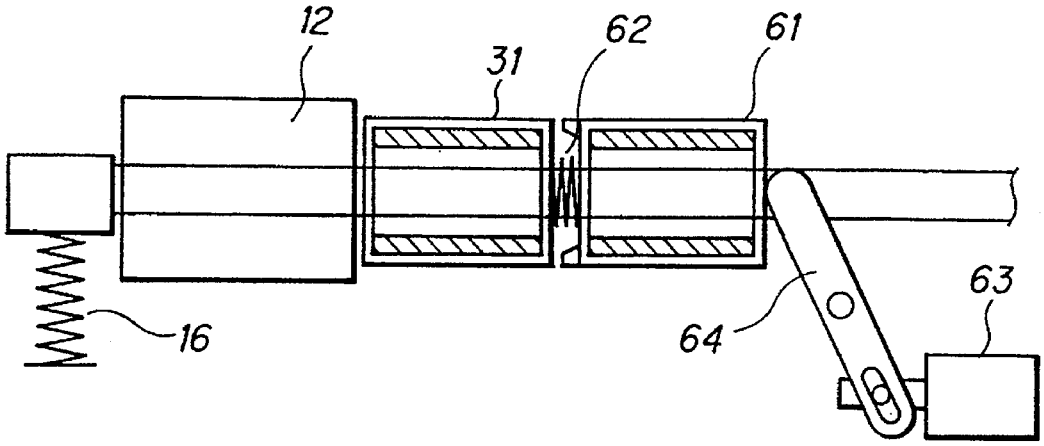
FIG. 25 is a schematic view showing a further paper feeder according to the present invention.

FIG. 25 shows the essentials of a paper feeder for carrying out this method. The reverse roller 13 is fitted with a torque limiter 31, as stated above, to control the torque of the reverse roller 13. In this example, another torque limiter 61 is fitted in series with the torque limiter 31. Fitted between the torque limiters 31 and 61 is a spring 62 for engagement and disengagement, which urges the torque limiter 61 away from the torque limiter 31. The torque limiter 61 can be forced against the force of the spring 62 by a solenoid 63 through a lever 64. If the solenoid 63 is rendered operative, the lever 64 presses the torque limiter 61 toward the reverse roller 13. This couples the torque limiters 61 and 31 together to increase the torque value of the reverse roller 13. If the solenoid 63 is inoperative, the torque limiter 61 is disengaged from the torque limiter 31 by the force of the spring 62, so that the torque limiter 31 alone sets the torque value of the reverse roller 13. This decreases the torque value.

Figure 26:
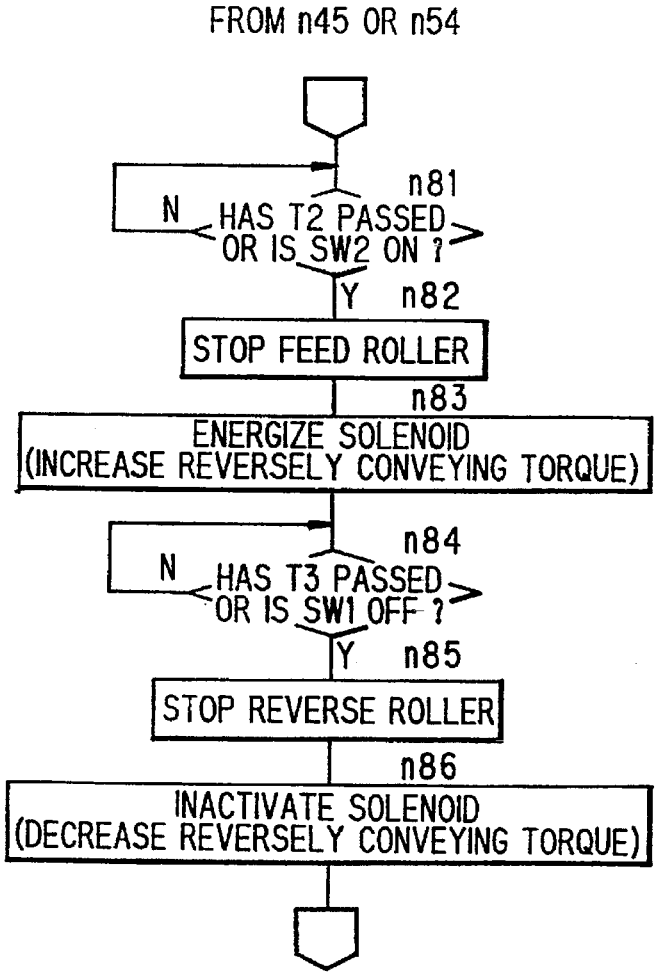
FIG. 26 is a flowchart showing a feeding procedure in the feeder.
Figure 27:
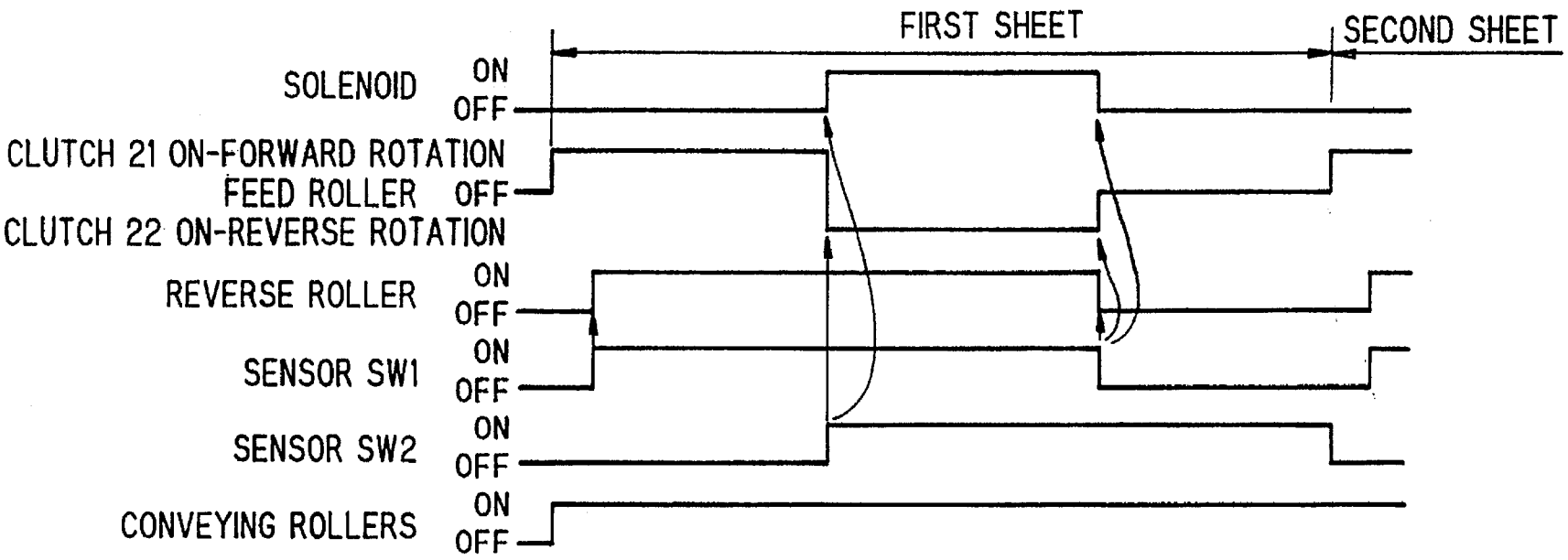
FIG. 27 is a timing chart showing the procedure.

The feeding procedure with this feeder is explained below. FIGS. 26 and 27 are a flowchart and a timing chart, respectively, showing the procedure. The rotation of the feed roller 12 and the reverse roller 13 feeds a sheet of paper. If the sheet front end has reached the conveying rollers 18, the feed roller 12 stops (Steps n81 and n82). At the same time, the solenoid 63 is rendered operative, so that the torque value of the reverse roller 13 increases (Step n83). This increases the conveying force F2 in the reverse direction with the reverse roller 13, thereby to improve the effectiveness of double feed prevention. If the sheet has completely passed over between the feed roller 12 and the reverse roller 13, the reverse roller 13 is stopped, and the torque value of the reverse roller 13 is returned to its original state. This ends the feed of one sheet. (Steps n84, n85 and n86)

The structure for varying the reverse roller 13 mounting angle θ (3) is explained below.

Figure 28:
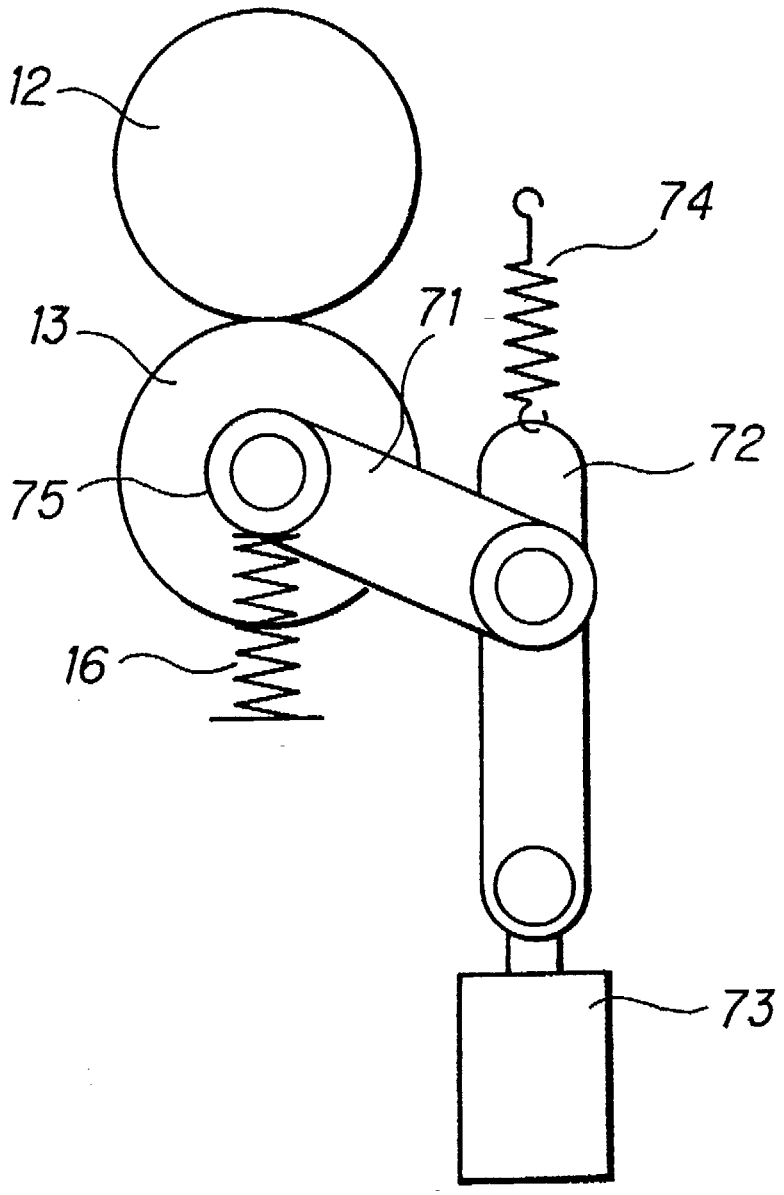
FIG. 28 is a schematic view showing a still further paper feeder according to the present invention.

FIG. 28 shows the structure of the essentials of a paper feeder for carrying out this method. The reverse roller 13 is supported on one end of an urging lever 71, and urged against the feed roller 12 by a spring 16. The other end of the lever 71 is supported on a shift lever 72, which can slide vertically, and the sliding action is controlled by a solenoid 73 and a spring 74. If the solenoid 73 is rendered operative, the shift lever 72 is pulled down against the tensile force of the spring 74, so that the adjacent end of the urging lever 71 moves down. That is to say, the urging fulcrum 75 of the lever 71 is shifted down, thereby to increase the angle θ at which the reverse roller 13 is mounted (the angle between the fulcrum 75 and the plane between the feed roller 12 and the reverse roller 13). If the solenoid 73 is inoperative, the shift lever 72 is pulled by the spring 74 and slides up to shift the fulcrum 75 upward, thereby reducing the reverse roller 13 mounting angle θ. For example, if the angle θ is set at 20° when the fulcrum 75 is positioned upward, and at 45° when it is positioned downward, the conveying force $F_2$ in the reverse direction is larger at θ=45° than at θ=20°. If $F_2$ increases, the effectiveness of double feed prevention increases. If $F_2$ decreases, it becomes possible to feed paper smoothly without interrupting the feeding action.

Figure 29:
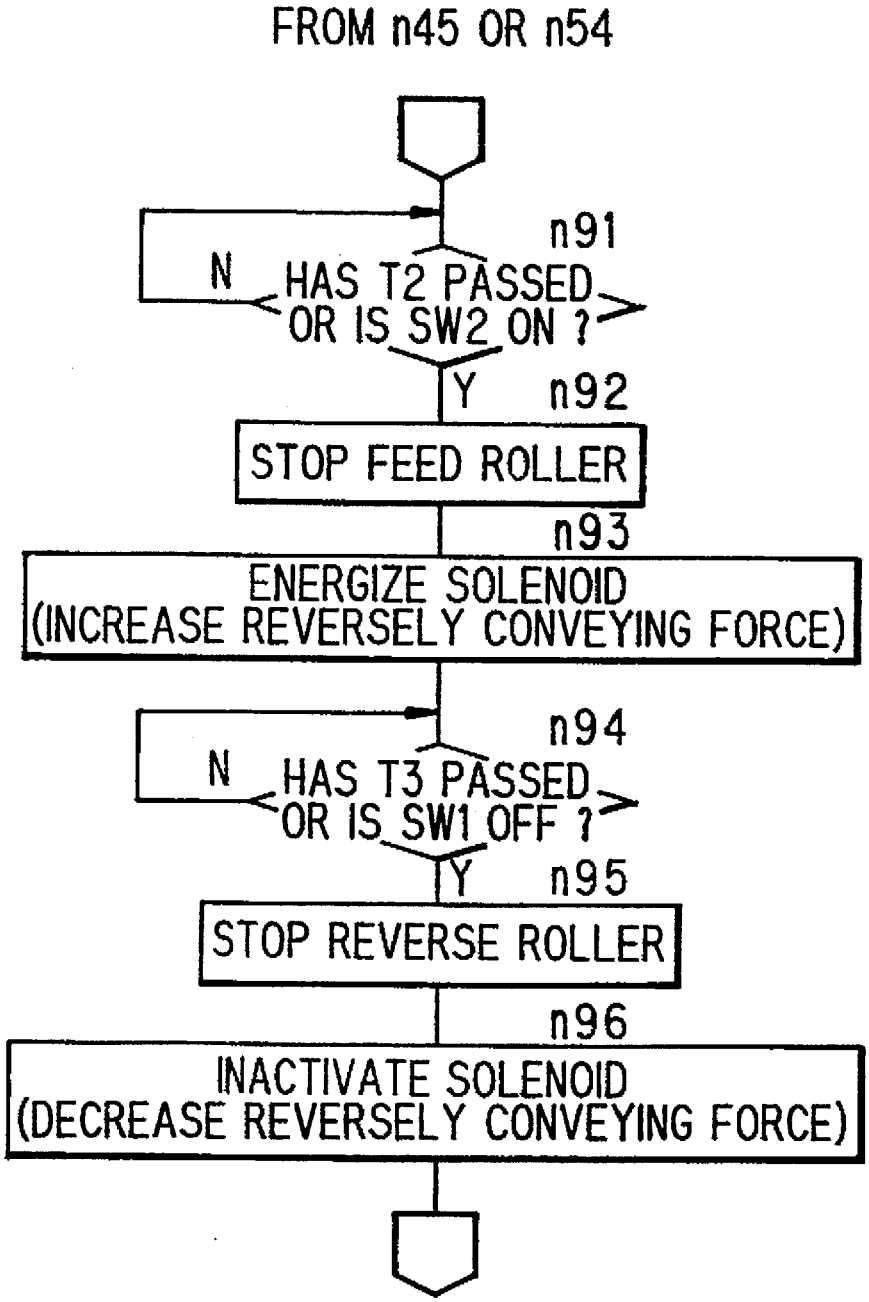
FIG. 29 is a flowchart showing a feeding procedure in the feeder.
Figure 30:
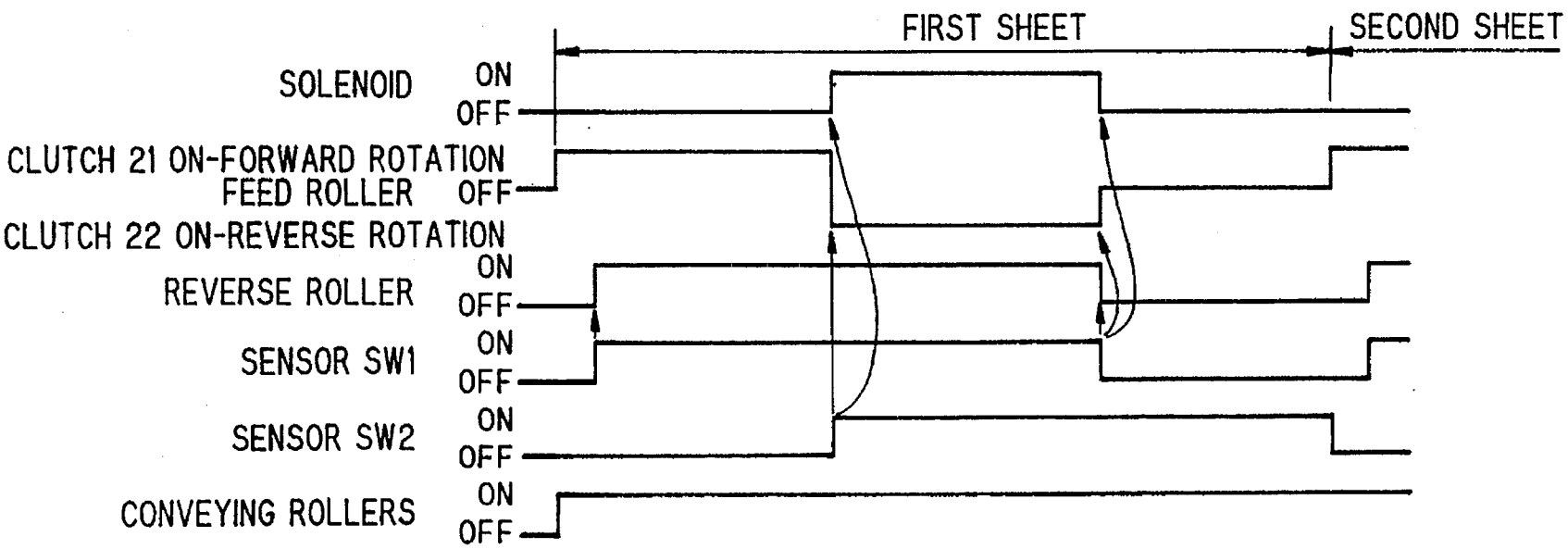
FIG. 30 is a timing chart showing the procedure.

The feeding procedure with this feeder is explained below. FIGS. 29 and 30 are a flowchart and a timing chart, respectively, showing the procedure. The rotation of the feed roller 12 and the reverse roller 13 feeds a sheet of paper. If the sheet front end has reached the conveying rollers 18, the feed roller 12 stops (Steps n91 and n92). Also, the solenoid 73 is rendered operative to make the reverse roller 13 mounting angle θ=45°, thereby increasing the conveying force $F_2$ in the reverse direction (Step n93). This improves the effectiveness of double feed prevention. If the sheet has completely passed over between the feed roller 12 and the reverse roller 13, the reverse roller 13 is stopped, and the torque value of the reverse roller 13 is returned to its original state. This ends the feed of one sheet. (Steps n94, n95 and n96).

As shown above, the rotation of the feed roller 12 feeds a sheet of paper and, after the sheet front end has reached the conveying rollers 18, the sheet is conveyed by the conveying rollers 18. At the feed roller 12 and the reverse roller 13, double feed can be prevented by keeping the reverse roller 13 rotating. Further, double feed can be prevented more reliably by reversely rotating the feed roller 12 to help a sheet be returned, or by increasing the conveying force $F_2$ in the reverse direction with the reverse roller 13, or by other auxiliary operations.

According to the paper feeders of the present invention, as clear from the foregoing explanation, even if the feed roller or the reverse roller wears, the reverse roller does not rotate reversely to the feed direction during the initial period of feed. This prevents bad bite during the initial feed period, so that misfeed may not occur. The longer the reverse torque is applied to the reverse roller, the more liable to wear the feed and reverse rollers are. In this structure, however, the reverse roller is reversed for a short time, so that the wear itself advances slowly. As a result, the lives of the feed and reverse rollers are long, thereby to save the trouble of roller replacement and the running costs.

Also, when the roller surfaces have not worn, it is possible to prevent noise which may occur due to the late start of the reverse roller. In addition, when the roller surfaces have worn, it is possible to prevent misfeed which may occur due to the reverse rotation of the reverse roller during the initial period of feed.

Also, if the front end of a sheet has reached the conveying rollers, they convey the sheet thereafter. Therefore, at the feed and reverse rollers, only actions for prevention of double feed can be made. Specifically, the rotation in the feed direction of the feed roller can be stopped, whereby only reversely conveying force can be applied by the reverse roller. This improves the effectiveness of prevention of double feed. In addition, the reverse roller is stopped after a sheet being fed passes over completely between the feed and reverse rollers, thereby to prevent double feed reliably.

Also, the fulcrum of contact pressure for urging the reverse roller against the feed roller is set at about 45° or about 225° clockwise with respect to the plane between the feed and reverse rollers, which is downstream in the feed direction. Consequently, when the reverse roller is urged against the feed roller, the range of the contact pressure can have play to some extent, thereby to lower the costs for precision of the apparatus.

Also, even when it is not possible to set the fulcrum of the reverse roller at about 45° or about 225° as stated in the above paragraph, the contact pressure range can be set wide by stopping the reverse roller. This can reduce the costs for contact precision of the apparatus.

What is claimed is:

1. A paper feeder comprising:

a feed roller to which forward torque in the feed direction is transmitted;

a reverse roller rotatable in cooperation with the feed roller;

means for urging the reverse roller against the feed roller;

means for applying torque opposite to the feed direction to the reverse roller;

means for counting a value which indicates the wear of the rollers surfaces;

means for starting the rollers rotating at the same time when the counted value is equal to or smaller than a predetermined value; and means for transmitting the opposite torque to the reverse roller after a certain time after the forward torque is started being transmitted to the feed roller when the counted value exceeds the predetermined value.

2. A paper feeder as set forth in claim 1 and further comprising:

conveying rollers located downstream from the feed roller so as to convey paper in the feed direction;

means for stopping the feed roller from rotating in the feed direction when the front end of a paper sheet being conveyed has reached the conveying rollers;

means for keeping the reverse roller rotating after the feed roller is stopped from rotating until the rear end of the sheet being fed has passed between the feed and reverse rollers; and means for stopping the reverse roller from rotating after the sheet rear end passes between the feed and reverse rollers.

3. A paper feeder as set forth in claim 1, wherein the means for counting counts the number of paper sheets that have passed through the rollers, so that the wear on the surface rollers is determined.

4. A paper feeder as set forth in claim 3, wherein the means for counting additionally counts a number of sheets that have resulted in jams between the rollers.

5. A paper feeder comprising:

a feed roller means for applying forward torque to the feed roller in a paper feed direction;

a reverse roller rotatable in cooperation with the feed roller;

means for urging said reverse roller against the feed roller;

means for applying torque in the feed direction to said feed roller;

means for applying reverse torque to said reverse roller which is opposite to said feed direction; applied said reverse torque being after a time period after the torque has been applied to the feed roller;

conveying rollers located downstream from the feed roller so as to convey paper in the feed direction;

means for stopping the feed roller from rotating in the feed direction when the front end of a paper sheet being conveyed has reached the conveying rollers;

means for keeping the reverse roller rotating after the feed roller is stopped from rotating until the rear end of the sheet being fed has passed between the feed and reverse rollers; and means for stopping the reverse roller from rotating after the sheet rear end passes between the feed and reverse rollers.

6. A paper feeder comprising:

a feed roller to which forward torque in the feed direction is transmitted;

a reverse roller, means for urging the reverse roller against the feed roller;

a torque limiter, for allowing the reverse roller to rotate in cooperation with the feed roller when one sheet of paper passes between the rollers, and which causes the reverse roller to rotate in a reverse direction to the feed roller when two or more sheets of paper pass between the rollers; and an urging lever having one end supported pivotably on an urging fulcrum, means for applying force to the urging lever for applying contact pressure to the reverse roller;

the fulcrum being located in a position at an angle of about 45° or about 225° clockwise with respect to the plane between the rollers, the plane being located parallel to a contact surface between the rollers with the angles being measured from that portion of the plane that extends in a feed direction which is the direction after one sheet of paper has passed through and beyond the rollers.

7. A paper feeder comprising:

a feed roller to which forward torque in the feed direction is transmitted;

a reverse roller urged against the feed roller; and an urging lever having one end supported pivotably on an urging fulcrum, means for applying force to the urging lever for applying contact pressure to the reverse roller, the fulcrum being located in a position at an angle except for about 135° and about 315° clockwise with respect to the plane between the rollers, the plane being located parallel to a contact surface between the rollers with the angles being measured from that portion of the plane that extends in a feed direction which is the direction after one sheet of paper has passed through and beyond the rollers, and the reverse roller being fitted with a torque limiter, which allows the reverse roller to rotate in cooperation with the feed roller when one sheet of paper passes between the rollers, and which stops the reverse roller from rotating when two or more sheets of paper pass between the rollers.

* * * * *